US011111563B2

(12) United States Patent
Enneti et al.

(10) Patent No.: US 11,111,563 B2
(45) Date of Patent: Sep. 7, 2021

(54) HIGH STRENGTH AND EROSION RESISTANT POWDER BLENDS

(71) Applicant: GLOBAL TUNGSTEN & POWDERS CORP., Towanda, PA (US)

(72) Inventors: Ravi K. Enneti, Towanda, PA (US); Kevin Prough, Athens, PA (US); Keith Newman, Athens, PA (US)

(73) Assignee: GLOBAL TUNGSTEN & POWDERS CORP., Towanda, PA (US)

( * ) Notice: Subject to any disclaimer, the term of this patent is extended or adjusted under 35 U.S.C. 154(b) by 275 days.

(21) Appl. No.: 16/084,106

(22) PCT Filed: Sep. 10, 2018

(86) PCT No.: PCT/US2018/050215

§ 371 (c)(1),
(2) Date: Sep. 11, 2018

(87) PCT Pub. No.: WO2019/078975

PCT Pub. Date: Apr. 25, 2019

(65) Prior Publication Data

US 2020/0063244 A1 Feb. 27, 2020

Related U.S. Application Data

(60) Provisional application No. 62/574,469, filed on Oct. 19, 2017.

(51) Int. Cl.
*C22C 29/08* (2006.01)
*C22C 1/05* (2006.01)
(Continued)

(52) U.S. Cl.
CPC ..... *C22C 29/08* (2013.01); *C22C 1/051* (2013.01); *C22C 9/00* (2013.01); *B22F 7/06* (2013.01); *B22F 2005/001* (2013.01)

(58) Field of Classification Search
CPC . C22C 29/08; C22C 1/051; C22C 9/00; B22F 7/06; B22F 2005/001
See application file for complete search history.

(56) References Cited

U.S. PATENT DOCUMENTS 5,830,256 A 11/1998 Northrop et al.
6,287,360 B1 9/2001 Kembaiyan et al.
(Continued)

FOREIGN PATENT DOCUMENTS

CA 2 576 072 7/2007
CN 105154742 B 3/2017
(Continued)

OTHER PUBLICATIONS

EnerMet Tungsten Powders for the Oil & Gas Industry. GTP. Technical Information Bulletin. (Year: 2017).*
(Continued)

*Primary Examiner* — Anthony J Zimmer
*Assistant Examiner* — Ricardo D Morales
(74) *Attorney, Agent, or Firm* — Ballard Spahr LLP

(57) ABSTRACT

Composites comprising various fractions of ultra coarse (UC) tungsten carbide (WC) and cast carbide (CC), along with composites comprising fractions of UC-WC and CC having various particle size and showing an improved strength and erosion resistance, and methods for making the inventive composites.

18 Claims, 16 Drawing Sheets

(51) Int. Cl.

| | |
|---|---|
| ***C22C 9/00*** | (2006.01) |
| ***B22F 7/06*** | (2006.01) |
| ***B22F 5/00*** | (2006.01) |

(56) References Cited

U.S. PATENT DOCUMENTS

| | | | | |
|---|---|---|---|---|
| 7,232,473 | B2 * | 6/2007 | Elliott | A01K 95/005 419/36 |
| 2002/0078794 | A1 | 6/2002 | Bredthauer et al. | |
| 2008/0206585 | A1 | 8/2008 | Deng et al. | |
| 2008/0289880 | A1 | 11/2008 | Majagi et al. | |
| 2010/0320004 | A1 * | 12/2010 | Deng | C22C 29/08 175/426 |

FOREIGN PATENT DOCUMENTS

| | | |
|---|---|---|
| WO | PCT/US2018/050215 | 9/2018 |
| WO | WO-2019/078975 A1 | 4/2019 |

OTHER PUBLICATIONS

Purple Pavilion Ltd. Steel Knot Cemented Carbide. (Year: 2020).*
ASTM. B527 20 Tap density standard. (Year: 2020).*
International Search Report and Written Opinion dated Dec. 11, 2018 by the International Searching Authority for Patent Application No. PCT/US2018/050215, which was filed on Sep. 10, 2018 (Inventor—Ravi K. Enneti; Applicant—Global Tungsten & Powders Corp.; (8 pages).
Deshpande, P.K. et al., Infrared processed Cu composites reinforced with WC particles. Mater Sci Eng A. 2006; 429(1-2):58-65.
Gee, M.G. et al., Wear mechanisms in abrasion and erosion of WC/CO and related hard metals. Wear. 2007; 263:137-48.
Hong, E. et al., Tribological properties of copper alloy-based composites reinforced with tungsten carbide particles. Wear. 2011; 270(9-10):591-7.
Karimi, A. et al., Slurry erosion behavior of thermally sprayed WC-M coatings. Wear. 1995; 186-7(Part 2):480-6.
Kembaiyan, K.T. and Keshavan, K., Combating severe fluid erosion and corrosion of drill bits using thermal spray coating. Wear. 1995; 186-7(Part 2):487-92.
Kennedy, R.K. et al., The wetting and spontaneous infiltration of ceramics by molten copper. J Mater Sci. 2000; 35(12):2909-12.
Larsoon, P., Wear of a new type of diamond composite. Intl J Refract Metals Hard Mater. 1999; 17(6):453-60.
Miserez, A., Particle reinforced metals of high ceramic content. Mater Sci Eng A. 2004; 387-9:822-31.
Montgomery, R.S., The mechanism of percussive wear of tungsten carbide composites. Wear. 1968; 12:309-29.
Reyes, M. and Neville, A., Degradation mechanisms of Co-based alloy and WC metal-matrix composites for drilling tools offshore. Wear. 2003; 255:143-56.
Sandstrom, M.J., The solid particle erosion of tungsten carbide in silicon carbide slurry. Master's thesis, Department of mechanical engineering, University of Utah, 2003 (81 pages).
Zhou, R. et al., The effect of volume fraction of WC particles on erosion resistance of WC reinforced iron matrix surface composites. Wear. 2003; 255:134-8.
Restriction Requirement dated Oct. 12, 2018 by the U.S. Patent and Trademark Office for U.S. Appl. No. 15/349,065, filed Nov. 11, 2016 and published as US 2018/0094342 on Apr. 5, 2018 (Inventor—Enneti et al.; Applicant—Global Tungsten and Powders Corp.; (7 pages).
Non Final Rejection was dated Apr. 12, 2019 by the USPTO for U.S. Appl. No. 15/349,065, filed Nov. 11, 2016 and published as US 2018-0094342 A1 on Apr. 5, 2018 (Inventor—Ravi K. Enneti) (10 Pages).
U.S. Appl. No. 62/402,113, filed Sep. 30, 2016, Ravi K. Enneti (Global Tungsten and Powders Corp.).
U.S. Appl. No. 15/349,065 (2018/0094342), filed Jan. 11, 2016 (Apr. 5, 2018), Ravi K. Enneti (Global Tungsten and Powders Corp.).
U.S. Appl. No. 62/574,469, filed Oct. 19, 2017, Ravi K. Enneti (Global Tungsten and Powders Corp.).

* cited by examiner

| 1 | -80/+120 MESH | -325 MESH |
|---|---|---|
| UC-WC |   |   |
| 2 | -60/+120 MESH | -230/+325 MESH |
| CC |   |   |
| 3 | -60/+120 CC MESH | -325 UC-WC MESH |
| CC&UC-WC |   |   |
| 4 | -230/+325 CC MESH | -325 UC-WC MESH |
| CC&UC-WC |   |   |

HIGH STRENGTH AND EROSION RESISTANT POWDER BLENDS

CROSS-REFERENCE TO RELATED APPLICATIONS

The present application is a national phase filing under 35 U.S.C. § 371 of International Application No. PCT/US2018/050215, filed on Sep. 10, 2018, which claims priority to U.S. provisional application Ser. No. 62/574,469, filed on Oct. 19, 2017, the contents of which are both incorporated herein by reference in their entirety.

BACKGROUND

Technical Field

The present disclosure relates to blends of various fractions of ultra-coarse tungsten carbide (UC-WC) and cast carbide (CC) powders, and to infiltrated body powders comprising such blends and exhibiting superior strength and erosion resistance.

Technical Background

Polycrystalline diamond (PDC) bits used extensively for oil and gas exploration are subjected to harsh conditions of wear, erosion and corrosion in a high temperature environment during drilling operations. It was found that particle reinforced metal matrix composites (PRMMC) can be used in manufacturing of PDC bits to withstand the severe operating conditions resulting in extended life of the bit and lower drilling costs. For example, Cu alloy reinforced with WC particles prepared via an infiltration method was demonstrated to be one of the preferred PRMMC in manufacturing PDC bits owing to its unique properties of high temperature strength, superior wear resistance, and good toughness. It was shown that the interfacial bonding due to high wettability of Cu for WC, and absence of intermetallic formation due to low solubility of WC in Cu, assist in enhancing the properties of Cu—WC composites. However, Cu alloy matrices are also known to be highly susceptible to erosion, and thus there is a need to minimize an amount of Cu alloys in the composites to improve strength and erosion resistance.

Thus, there is a need for improved particle reinforced metal matrix composites having a lower composition of Cu, but improved erosion resistance as compared to conventional composites. Further, there is a need to provide composites having not only improved erosion resistance but also high strength that is comparable to conventional composites.

SUMMARY

In accordance with the purpose(s) of the invention, as embodied and broadly described herein, this disclosure, in one aspect, relates to a composite comprising: a) about 40-70 wt % of a fraction of ultra-coarse tungsten carbide (UC-WC); and b) about 30-60 wt % of a fraction of cast carbide (CC) having a tap density of about 9-11.5 g/cm$^3$ and exhibiting volume loss of at least 20% lower as compared to the conventional metal powder when measured accordingly to ASTM G65 and ASTM G76.

In another aspect, disclosed herein is a composite comprising one or more of: (a) from about 5 to about 25 wt % of a fraction of ultra-coarse tungsten carbide having a particle size of greater than 63 micrometer but smaller than 88 micrometer; (b) from about 5 to about 25 wt % of a fraction of ultra-coarse tungsten carbide having a particle size of greater than 44 micrometer but smaller than 63 micrometer; (c) from about 5 to about 25 wt % of a fraction of cast carbide having a particle size of greater than 63 micrometer but smaller than 88 micrometer; or d) from about 5 to about 25 wt % of a fraction of cast carbide having a particle size of greater than 63 micrometer but smaller than 125 micrometer.

Also disclosed herein is a composite exhibiting a Transverse Rupture Strength (TRS) of greater than 120 KSI. And even further, disclosed herein is the composite exhibiting a volume loss under abrasion testing according to ASTM G65 of less than about 6 mm$^3$.

In yet other aspects, the present disclosure provides a method for preparing a composite comprising: a) contacting about 40-70 wt % of a fraction of ultra coarse tungsten carbide with about 30-60 wt % of a fraction of cast carbide (CC) to form a blend; b) tapping the blend for at least 5 cycles; and c) infiltrating the blend with a copper containing alloy wherein the formed composite has a tap density of about 9-11.5 g/cm$^3$ and exhibits volume loss of at least 20% lower as compared to the conventional metal powder when measured accordingly to ASTM G65 and ASTM G76.

The accompanying figures, which are incorporated in and constitute a part of this specification, illustrate several aspects and together with the description serve to explain the principles of the invention.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

Figure 28:
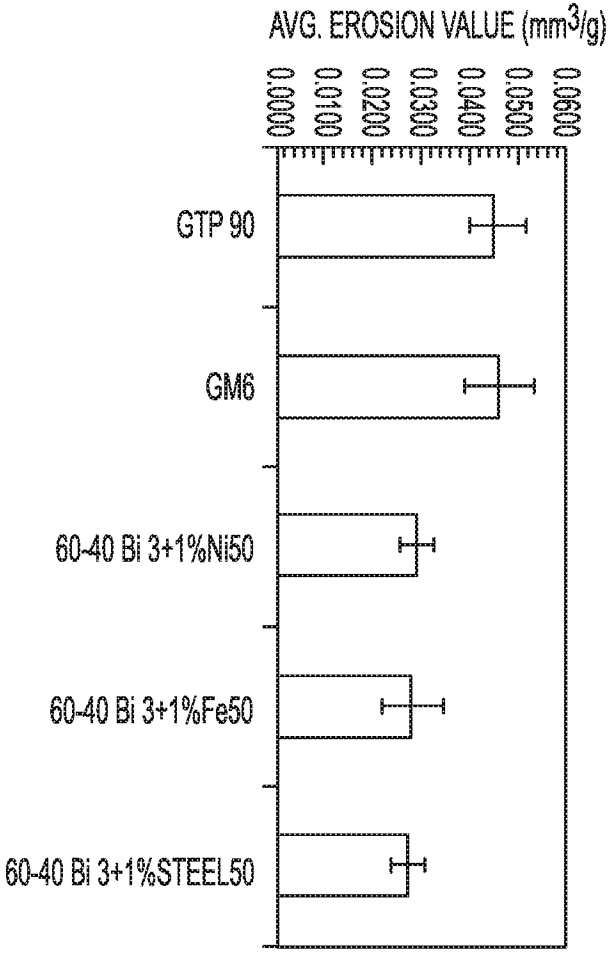

FIG. 28 depicts a comparison in a volume loss measured according to ASTM G76 for infiltrated samples made from bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh) containing various alloying elements that were prepared accordingly to the various aspects of the present disclosure and a standard blends.

Figure 29A:
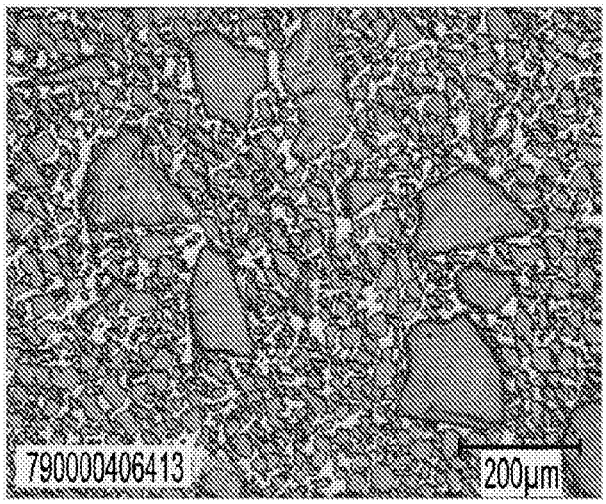
Figure 29B:
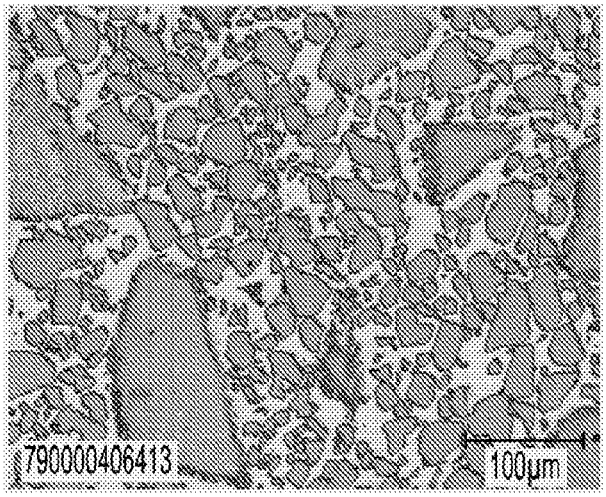
Figure 29C:
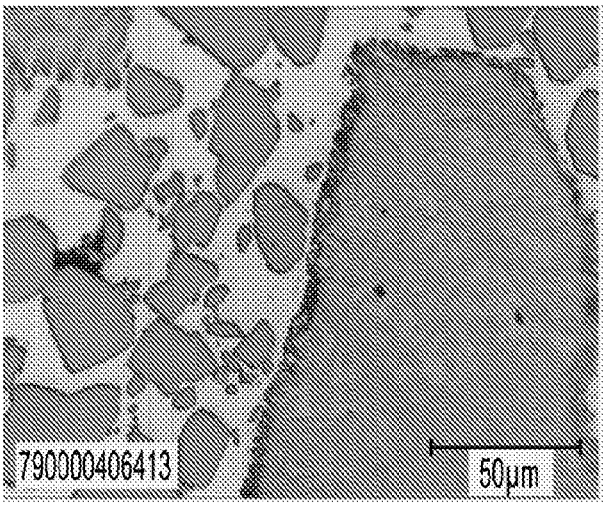

FIG. 29 depicts SEM images at various magnifications of the bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh), in accordance with various aspects of the present disclosure.

DESCRIPTION

The present invention can be understood more readily by reference to the following detailed description of the invention and the Examples included therein.

Before the present compounds, compositions, articles, systems, devices, and/or methods are disclosed and described, it is to be understood that they are not limited to specific synthetic methods unless otherwise specified, or to particular reagents unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

Definitions

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, example methods and materials are now described.

As used herein, unless specifically stated to the contrary, the singular forms "a," "an" and "the" include plural referents unless the context clearly dictates otherwise. Thus, for example, reference to "a fraction" or "a composition" includes blends of two or more fractions, or presence of two or more compositions, respectively.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

Disclosed are the components to be used to prepare the compositions of the invention as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these compounds cannot be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the compositions of the invention. Thus, if there are a variety of additional steps that can be performed it is understood that each of these additional steps can be performed with any specific embodiment or combination of embodiments of the methods of the invention.

As used herein, the terms "optional" or "optionally" means that the subsequently described event or circumstance can or can not occur, and that the description includes instances where said event or circumstance occurs and instances where it does not.

As used herein, the term "substantially" can in some aspects refer to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

In other aspects, as used herein, the term "substantially free," when used in the context of a composition or component of a composition that is substantially absent, is intended to refer to an amount that is than about 1% by weight, e.g., less than about 0.5% by weight, less than about 0.1% by weight, less than about 0.05% by weight, or less than about 0.01% by weight of the stated material, based on the total weight of the composition.

References in the specification and concluding claims to parts by weight of a particular element or component in a composition or article, denotes the weight relationship between the element or component and any other elements or components in the composition or article for which a part by weight is expressed. Thus, in a composition or a selected portion of a composition containing 2 parts by weight of component X and 5 parts by weight component Y, X and Y are present at a weight ratio of 2:5, and are present in such ratio regardless of whether additional components are contained in the composition.

A weight percent of a component, unless specifically stated to the contrary, is based on the total weight of the formulation or composition in which the component is included.

Each of the materials disclosed herein are either commercially available and/or the methods for the production thereof are known to those of skill in the art.

It is understood that the compositions disclosed herein have certain functions. Disclosed herein are certain structural requirements for performing the disclosed functions; and it is understood that there are a variety of structures that can perform the same function that are related to the disclosed structures, and that these structures will typically achieve the same result.

Unless specifically referred to the contrary herein, terms tungsten carbide or WC are used interchangeably and are intended to refer to a monocrystalline tungsten carbide. It should be understood that monocrystalline tungsten carbide can be substantially monocrystalline, but that small amounts of other tungsten carbide materials can be present.

Unless specifically referred to the contrary herein, CC is intended to refer to a cast carbide, or an eutectic mixture of WC and $W_2C$.

Unless specifically referred to the contrary herein, Transverse Rupture Strength (TRS) is intended to refer to the stress in a material just before it yields in a flexural test.

Unless specifically referred to herein, UC-WC is intended to refer to an ultra-coarse tungsten carbide powder. An UC-WC powder can, in various aspects, be manufactured from tungsten metal powder blended with carbon and subjected to temperatures high enough and for a time sufficient to coarsen the powder into particles of the desired sieve size. The UC-WC formation process is diffusion limited and is thus, thermally driven. Thus, the process is preferably performed at temperatures of at least about 2,200° C. or greater. While lower temperatures can be employed, such temperatures can extend cycle times to unreasonable lengths. In one aspect, carburization of the powder can be performed in small, self-contained elements, for example, having a volume of about 1 $in^3$ each. In an exemplary aspect, a tungsten metal powder (WMP), such as for example, an M63 (available from Global Tungsten & Powders Corp., Towanda, Pa., USA) having an average particle size of from about 7.90 μm to about 10.90 μm (ASTM B330), a bulk density of from about 55 $g/in^3$ to about 90 $g/in^3$ (ASTM B329), a loss on reduction (LOR) of about 0.10% (ASTM E159), and about 99.95% purity, and an N990 carbon black can be ball-milled to a target carbon loading of 6.00 wt. %. The resulting mixture can be placed in a self-contained element, as described above, and carburized under a flow of nitrogen. After carburization, the resulting piece can be broken into smaller pieces and then subjected to high energy comminution via hammermilling using, for example, a Model WA-8-H Hammermill from Schutte Buffalo, Buffalo, N.Y., USA. UC-WC powders are commercially available, for example, from Global Tungsten & Powders, Towanda, Pa., USA. References to poly G, unless specifically described otherwise, are intended to refer to a polyether polyol material, such as those typically used in infiltrated alloys and cutting materials. Such materials, such as poly G, are commercially available and one of skill in the art could readily procure such materials for use in carrying out the various aspects of the present disclosure.

It should be understood that the present disclosure refers to various particle size fractions and that the particle size of any of the materials described herein are distributional properties. Accordingly, a particle size fraction can, in various aspects, comprise a small amount of particles either larger than or smaller than the given size fraction. It should also be understood that the average size of any given particle size fraction can vary. In one aspect, a size fraction of a material can be represented by standard U.S. sieve sizes. In an exemplary aspect, a fraction can be defined as 230/325, meaning that the particles pass through the holes of a 230 mesh screen (i.e., 63 μm opening) but not through the holes of a 325 mesh screen (i.e., 44 μm opening).

References to G65 are intended to refer to ASTM G65 (Standard Test Method for Measuring Abrasion Using the Dry Sand/Rubber Wheel Apparatus). The ASTM G65 test simulates sliding abrasion conditions under moderate pressure, using dry sand metered between a rubber wheel and a block coupon of the material being evaluated. The test allows comparison of wear-resistant materials by their volume loss in cubic millimeters, with materials of higher wear resistance showing lower volume loss. The values states in SI units are to be regarded as standard.

References to B611 are intended to refer to ASTM B611-13 (Standard Test Method for Determining the High Stress Abrasion Resistance of Hard Materials). The B611 test is designed to simulate high-stress abrasion conditions. Unlike low-stress abrasion techniques, where the abrasive remains relatively intact during testing, the B611 test simulates applications where the force between an abrasive substance and a surface is sufficient to crush the abrasive. The B611 test employs a water slurry of aluminum oxide particles as the abrasive medium and a rotating steel wheel to force the abrasive across a flat test specimen in line contact with the rotating wheel immersed in the slurry. The values states in SI units are to be regarded as standard.

References to G76 are intended to refer to ASTM G76 (Standard Test Method for Conducting Erosion Test by Solid Particle Impingement Using Gas Jets). This test method covers the determination of material loss by gas-entrained solid particle impingement erosion with jet nozzle type erosion equipment. The values states in SI units are to be regarded as standard.

Composite

Body powder blends used for making PRMMC composites in PDC bits are typically made from a combination of various size fractions of WC ((Ultra coarse, UC-WC) and cast carbide (CC) powders. The ASTM G65 wear test method which uses low hardness $SiO_2$ as the abrasive material was found to have wear effect only on the matrix (Cu alloy). This test can be found to be useful for evaluating the erosion properties of the body powder blends. In the aspects disclosed herein, the G65 wear testing of infiltrated samples of various size fractions of ultra-coarse tungsten carbide (UC-WC) and cast carbide (CC) powders showed strong dependency on the tap density and volume of matrix. It is further understood that in the aspects of the current disclosure the infiltrant material itself is generally referred as "matrix."

In certain aspects, it was found that the G65 wear decreases with increase in the tap density of the powders i.e. low volume of matrix. In other aspects, the UC-WC and CC powders show opposite trends of variation in the tap density with a particle size. In some exemplary aspects, the tap density of UC-WC increases with a decrease in a particle size. In yet other aspects, the tap density of CC powders decreases with a decrease in a particle size.

In some aspects, the powder blends with superior erosion resistance properties are developed by minimizing the amount of matrix and maximizing the packing of UC-WC or CC. Several bi modal and tri modal blends using combinations of various size fractions of UC-WC and CC were prepared and analyzed for the tap density. The blends showing a high tap density were further analyzed for an infiltration density and a G65 wear loss.

In some aspects, the present disclosure provides materials useful in the manufacture of, for example, cutting tools, together with methods for the manufacture and use thereof. Polycrystalline diamond cutter (PDC) bits, used extensively in the oil and gas exploration industry, can be subjected to harsh wear, erosion, and corrosion, during use in high temperature environments. Particle reinforced metal matrix composites (PRMMC) are frequently used in the manufacture of PDC bits to withstand the harsh operating conditions and to extend bit life and reduce drilling costs. Conventional PRMMC materials utilize a copper alloy reinforced with tungsten carbide (WC) particles. The use of copper alloy can provide good interfacial bonding due to the wettability of copper for WC and the absence of intermetallic formation due to the low solubility of WC in the copper.

The copper alloy used in conventional PRMMC materials can vary, but can, in various aspects, comprise Cu, 24% Mn, 15% Ni, and 8% Zn.

While some conventional PRMMC materials comprise mixtures of UC-WC and CC materials, a fundamental understanding of the specific properties of each material, and especially of various size fractions of each material, have limited the development of PRMMC materials. By understanding these properties (e.g., bulk density, tap density, morphology, etc.), the present disclosure provides an inventive combination of materials that can exhibit improved strength, wear resistance, and/or abrasion resistance over conventional PRMMC materials.

Figure 1:
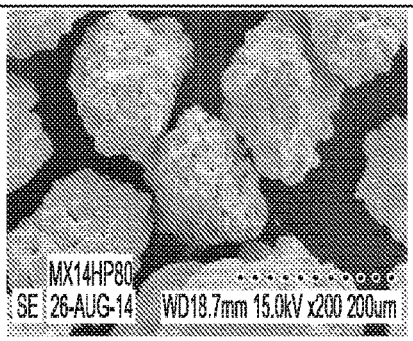
FIG. 1 depicts a table showing SEM images of various blends composition according to various aspects of the present disclosure.
Figure 1:
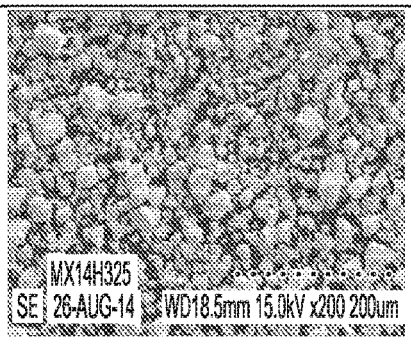
Figure 1:
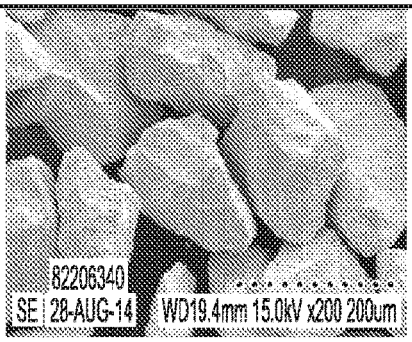
Figure 1:
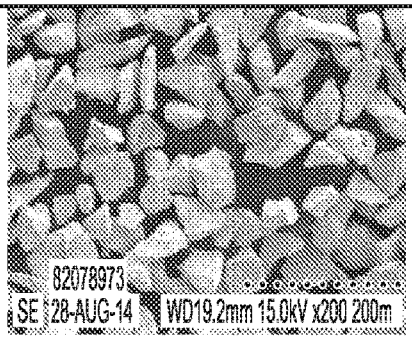
Figure 1:
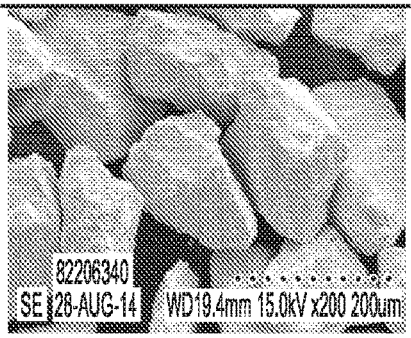
Figure 1:
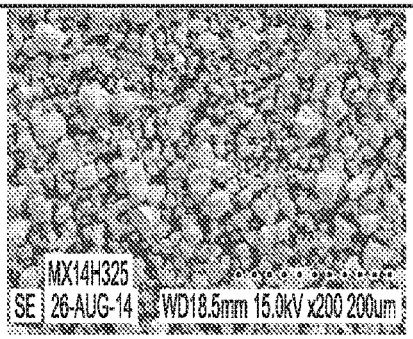
Figure 1:
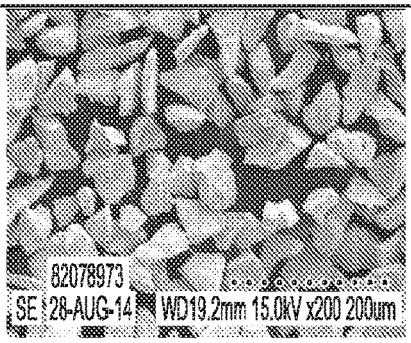
Figure 1:
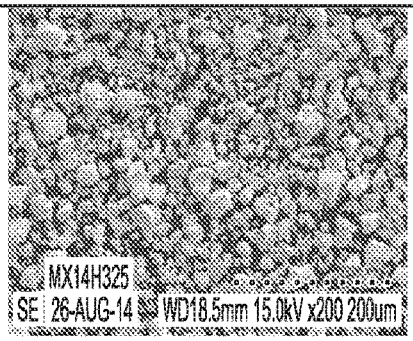

Experimental Procedure:

Bi modal and tri modal blends using combinations of various size fractions of UC-WC (−80/+120, −120/+170,−170/+230.−230/+325,−325 mesh) and CC (−60/+120, −80/+170, −120/+230, −170/+325, −230/+325 mesh) were prepared and analyzed for the tap density. Initially bi modal blends were prepared using various amounts of coarsest and finest fractions of UC-WC (80/120,−325) and CC (60/120, 230/325). The bi modal blends composition analyzed in the present study are shown in FIG. 1. Several compositions of bi modal Blend 1 were made by varying amounts of coarser and finer fraction of UC-WC carbide. Several compositions of bi modal Blend 2 were made by varying amounts of coarser and finer fraction of CC carbide. Similarly, several compositions of bi modal Blend 3 were made by varying amounts of finer fraction of UC WC and coarse fraction of CC and several compositions of bi modal Blend 4 were made by varying amounts of finer fraction UC WC and finer fraction of CC.

Bi modal blends were also made with the coarsest UC-WC (−80/120 mesh) and finest CC (−230/+325 mesh) powder fraction. However the bi modal blend showed low tap densities and was discarded for further studies.

The various compositions of each bi modal blends were analyzed for the tap density. The bi modal composition that yielded the highest tap density was identified from the measurements. The identified bi modal composition exhibiting the highest tap density was further used as a base powder for making tri modal blends. While make tri modal blends, the base bi modal powder exhibiting the highest tap density was mixed with 5-25 wt. % of remaining size fractions of UC-WC and CC that were not used for making the bi modal blend. For example the composition of 40 wt. % UC-WC 80/120 and 60 wt. % UC-WC −325 mesh showed the highest tap density amount all the blends made with various compositions for bi modal Blend 1. The 40 wt. % UC-WC −80/+120 mesh and 60 wt. % UC-WC −325 mesh bi modal powder was mixed with 5-25 wt. % of CC powder fractions (−60/+120, −80/+170, −120/+230, −170/+325, −230/+325 mesh) to obtain the tri modal blends. The tri modal blends were further analyzed for the tap density.

The bi modal and tri modal compositions showing the highest tap density were further identified as a potential body powder blend to exhibit superior erosion resistance. In these aspects, these potentially advantageous blends were infiltrated with Cu-24% Mn-15% Ni-8% Zn. The infiltrated samples were further analyzed for density, strength and wear properties. The strength of the infiltrated samples was measured using a three point bend test. The erosion and abrasion properties of infiltrated samples were measured using ASTM G65 and ASTM B611 methods.

Figure 2:
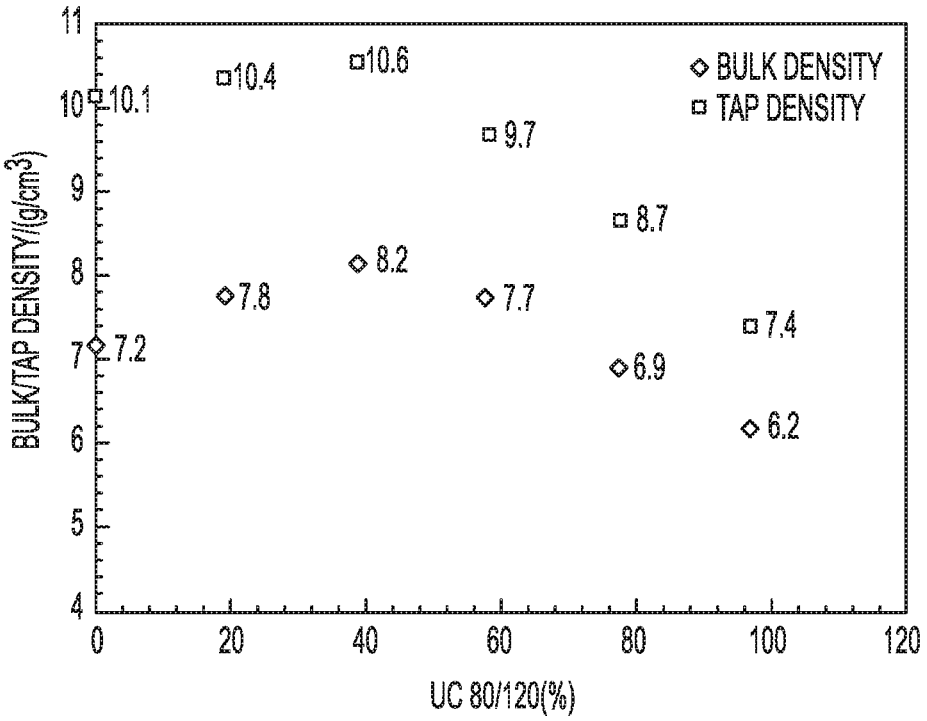
FIG. 2 depicts variations in bulk and tap density of a blend of ultra-coarse tungsten carbide having a particle size from about 125 micrometers (120 mesh) to about 177 micrometers (80 mesh) and ultra-coarse tungsten carbide having a particle size of about 44 micrometer (325 mesh), in accordance with various aspects of the present disclosure.

The variation in the bulk and tap density of bi modal Blend 1 with increasing content of UC 80/120 mesh powder is shown in FIG. 2. The bulk and tap density of the bi modal mixtures increased with an addition of UC-WC −80/+120 mesh fraction up to 40 wt. %. The bulk and tap density values decreased with a further increase in UC-WC −80/+120 mesh fraction amount above 40 wt. %. Among different compositions examined from bi modal Blend 1, the blend containing 40 wt. % UC-WC −80/+120 mesh and 60 wt. % UC-WC −325 mesh was identified as a potential candidate to exhibit higher erosion resistance. In the aspects, where bi modal Blend 1 powders was used, the Blend 1 further comprised about 3 wt. % of +80 UC-WC mesh powders.

Figure 3:
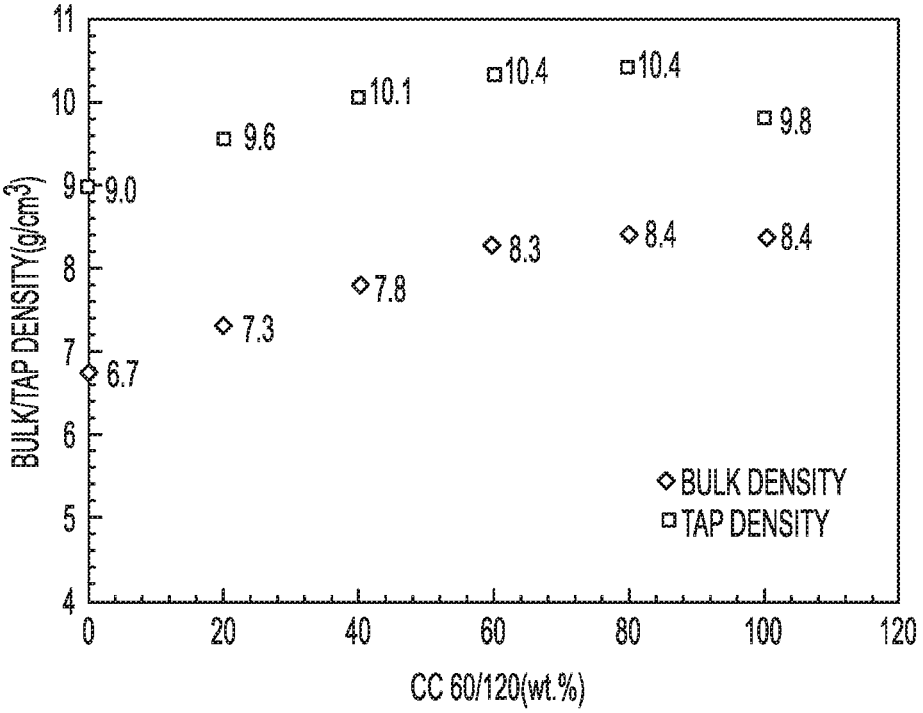
FIG. 3 depicts variations in bulk and tap density of a blend of cast carbide having a particle size from about 44 micrometers (325 mesh) to about 63 micrometers (230 mesh) and cast carbide having a particle size of about 125 micrometer (120 mesh) to about 250 micrometers (60 mesh), in accordance with various aspects of the present disclosure.

The variation in bulk and tap density of bi modal Blend 2 mixtures with an increasing content of C −60/+120 mesh powder is shown in FIG. 3. In certain aspects, the bulk and tap density of the bi modal mixtures increased with addition of −60/+120 mesh fraction reaching a maximum at 80 wt. % of CC having a particle size of −60/+120 mesh. In yet other aspects, the bulk and tap density of the blends decreased with a further increase in a composition of CC with a particle size of 60/120 mesh above 80 wt. %. In certain aspects, the blend containing 80 wt. % CC with a particle size of −60/+120 mesh and 20 wt. % CC with a particle size of −230/+325 mesh, exhibiting highest tap density was identified as a potential candidate to exhibit high erosion resistance.

Figure 4:
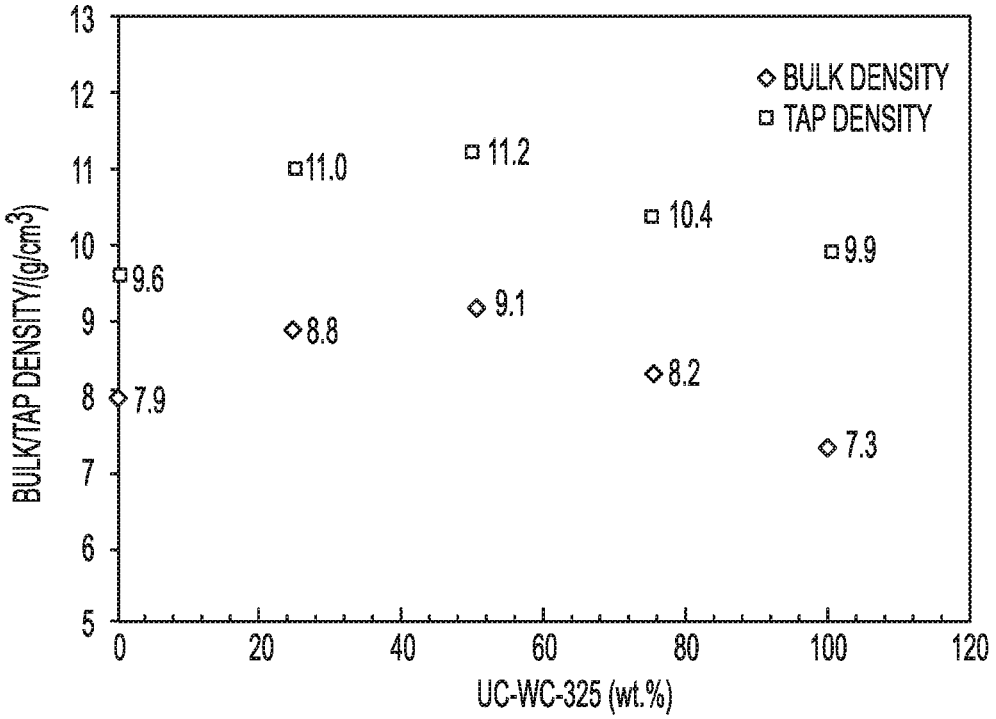
FIG. 4 depicts variations in bulk and tap density of a blend of cast carbide having a particle size from about 125 micrometers (120 mesh) to about 250 micrometers (60 mesh) and ultra-coarse tungsten carbide having a particle size of about 44 micrometers (325 mesh), in accordance with various aspects of the present disclosure.

The variation in the bulk and tap density of the bi modal Blend 3 with increasing content of UC-WC with a particle size of −325 mesh is shown in FIG. 4. In certain aspects, the bulk and tap density of the bi modal mixtures increased with addition of a UC-WC with a particle size of −325 mesh fraction up to 50 wt. %. In yet other aspects, the bulk and tap density values decreased with further increase in a UC-WC with a particle size of −325 mesh fraction amount above 50 wt. %. The blend containing 50 wt. % CC with a particle size of 60/120 mesh and 50 wt. % UC-WC with a particle size of −325 mesh exhibiting highest tap density was identified as a potential candidate to exhibit high erosion resistance.

Figure 5:
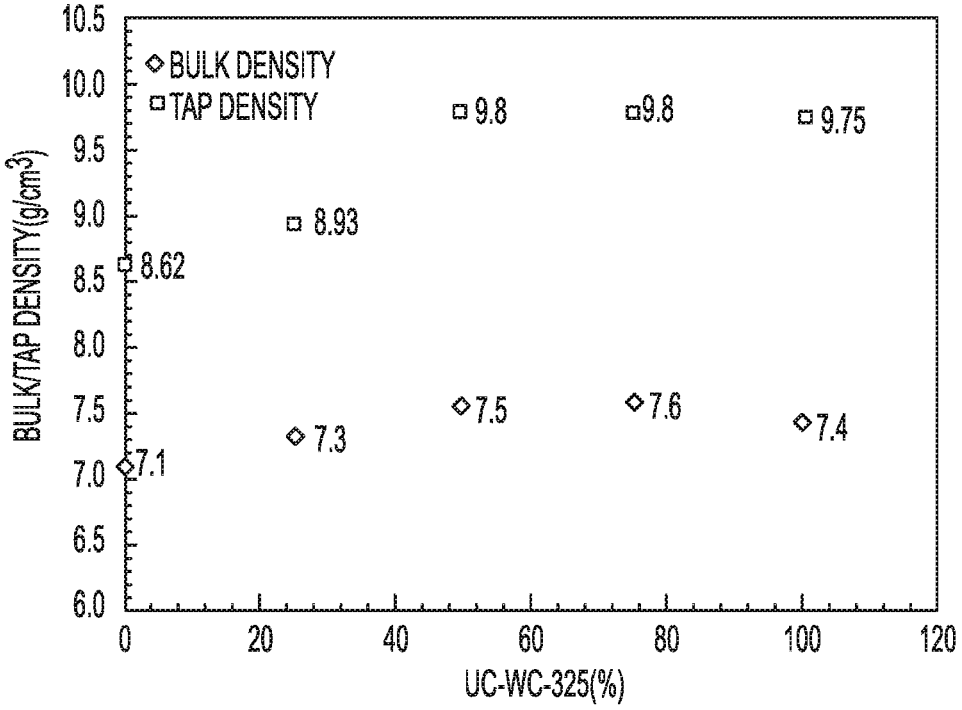
FIG. 5 depicts variations in bulk and tap density of a blend of cast carbide having a particle size from about 44 micrometers (325 mesh) to about 63 micrometers (230 mesh) and ultra-coarse tungsten carbide having a particle size of about 44 micrometers (325 mesh), in accordance with various aspects of the present disclosure.

The variation in the bulk and tap density of the bi modal Blend 4 with increasing content of UC-WC with a particle size of −325 mesh powder is shown in FIG. 5. In certain aspects, the bulk and tap density of the bi modal mixtures increased with addition of −325 mesh fraction up to 50 wt. %. In other aspects, the tap density values remained constant with further increase in −325 mesh fraction above 50 wt. %. The blend containing 25 wt. % CC with a particle size of 230/325 and 75 wt. % UC-WC with a particle size of −325 mesh exhibited the highest bulk and tap density and was identified as a potential candidate to exhibit high erosion resistance.

In certain aspects, the identified bi modal compositions exhibiting the highest tap density were further used as a base powder for making tri modal blends. In certain aspects, the tri modal blends were prepared to investigate the ability to further increase the tap density of the optimized bi modal powders. In some aspects, the tri modal blends were made by mixing the base bi modal powder exhibiting the highest tap density with 5-25 wt. % of various size fractions UC-WC/CC or UC WC and CC, depending on the composition of the base bi modal powder.

Figure 6:
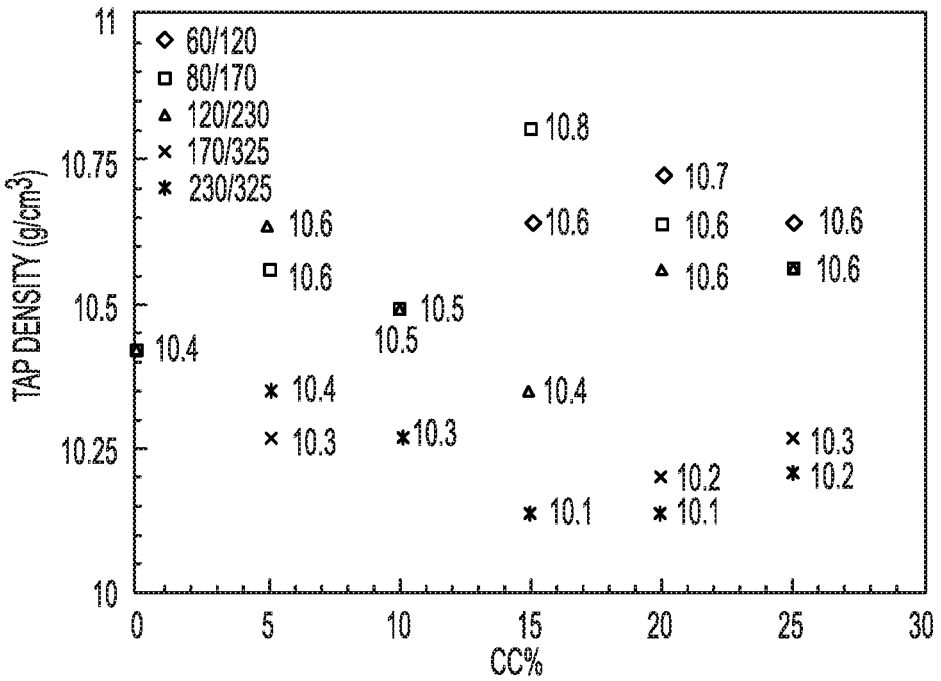
FIG. 6 depicts variations in tap density of a blend of 80 wt % of cast carbide having a particle size from about 125 micrometers (120 mesh) to about 250 micrometers (60 mesh) and 20% of cast carbide having a particle size of about 44 micrometers (325 mesh) to about 63 micrometers with addition of a second fraction of ultra-coarse tungsten carbide, in accordance with various aspects of the present disclosure.

In some aspects, the variation of tap density of tri modal blends prepared from mixing the bi modal Blend 1 (40 wt. % UC-WC with a particle size of −80/+120 mesh and 60 wt. % UC-WC with a particle size of −325 mesh) and 5-25 wt. % of CC powder fractions (with a particle size of: −60/+120, −80/+170, −120/+230, −170/+325, −230/−325 mesh) is shown in FIG. 6. In some aspects, the tap density of the bi modal powder increases with the addition of coarser fractions (particle sizes of: −60/+120, −80/+170 and −120/+230 mesh) of CC. In some aspects, the tap density increased from 10.4 g/cm$^3$ to a maximum of 10.8 g/cm$^3$ with addition of 15 wt. % of cast carbide (CC) with a particle size of 80/170 mesh. In other aspects, addition of finer fractions of cast carbide (particle sizes of: −170/+325 and −230/+325 mesh) resulted in a reduction of the bulk and tap density of the bimodal powder. In the aspects wherein the tri modal powders were prepared using bi modal Blend 1 powder blend, the powder blend further comprised about 3 wt. % UC-WC having a particle size of +80 mesh, 1 wt. % Fe and 1 wt. % steel. However there was no noticeable effect of the addition of 3 wt. % UC-WC having a particle size of +80 mesh, 1 wt. % Fe and 1 wt. % steel to the tap density of tri modal blends.

Figure 7:
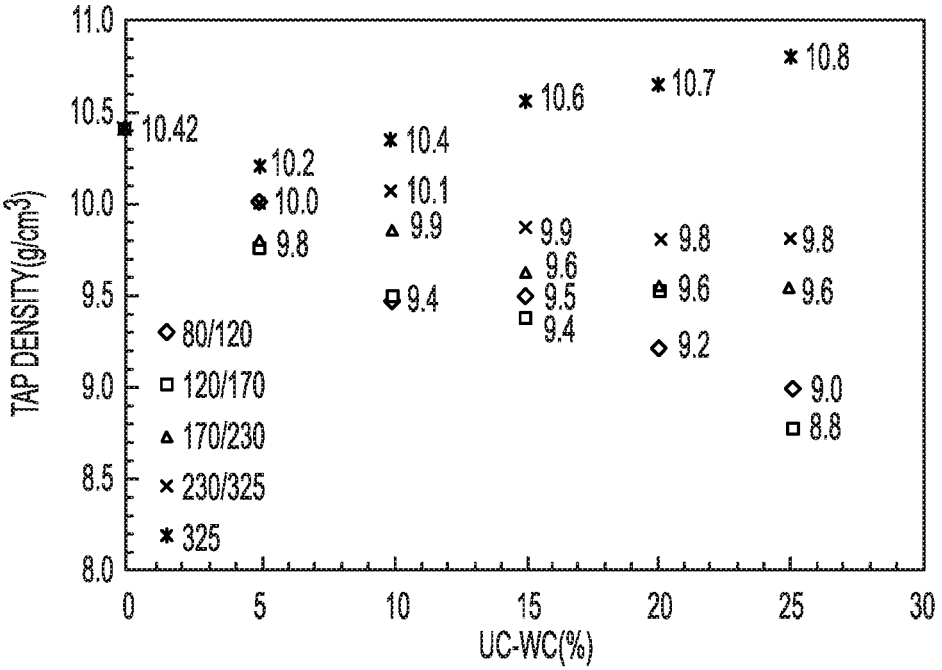
FIG. 7 depicts variations in tap density of a blend of 50 wt % of cast carbide having a particle size from about 125 micrometers (120 mesh) to about 250 micrometers (60 mesh) and 50% of ultra-coarse tungsten carbide having a particle size of about 44 micrometers (325 mesh) with addition of a second fraction of ultra-coarse tungsten carbide and a second fraction of cast carbide, in accordance with various aspects of the present disclosure.

The variation of the tap density of tri modal blends prepared from mixing the bi modal Blend 2 (80 wt. % CC with a particle size of −60/+120 mesh and 20 wt. % CC with a particle size −230/+325 mesh) and 5-25 wt. % of UC-WC powder fractions (with particle sizes of: −80/+120, −120/+170,−170/+230,−230/+325,−325 mesh) is shown in FIG. 7. All the size fractions of UC-WC except for −325 mesh resulted in lowering of the tap density of the base bi modal Blend 2 powder. In certain aspects where the UC-WC with a particle size of −325 mesh powder was added at quantities above 15 wt. %, an increase in the tap density of the bi modal powder was observed. In other aspects, the tap density of the bi modal powder increased from 10.42 g/cm$^3$ to a maximum of 10.8 g/cm$^3$ with the addition of 25 wt. % of −325 mesh UC-WC. All the tri modal powders prepared using bi modal Blend 2 further comprised 3 wt. % UC WC with a particle size of +80 mesh, 1 wt. % Fe and 1 wt. % steel. However there was no noticeable effect of addition of 3 wt. % UC WC with a particle size of +80 mesh, 1 wt. % Fe and 1 wt. % steel to the tap density of tri modal blends.

Figure 8:
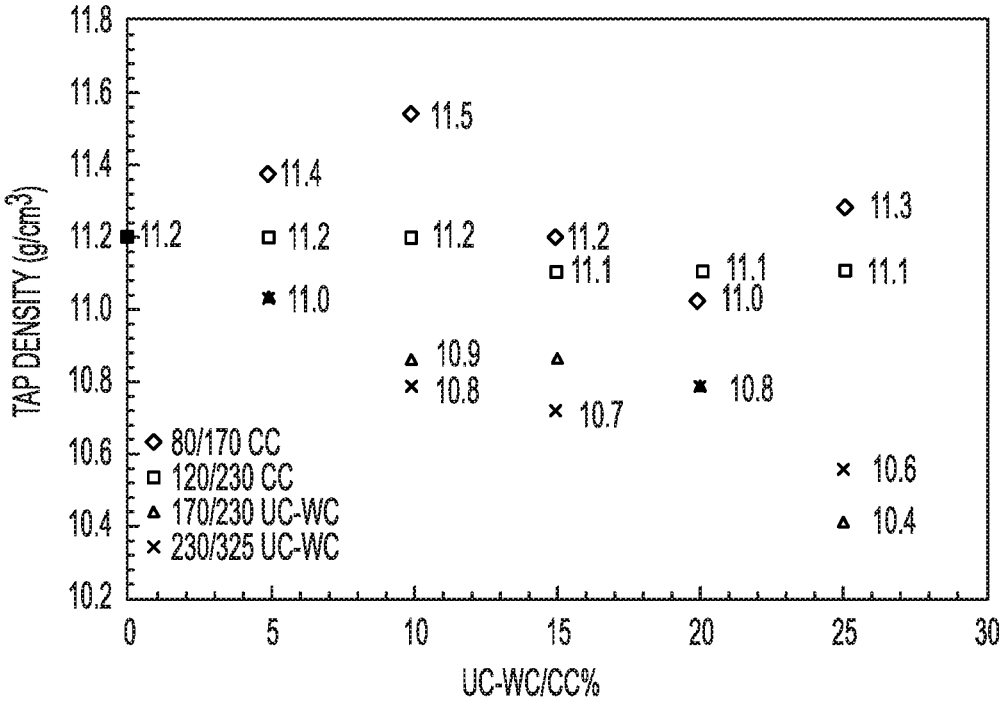
FIG. 8 depicts variations in tap density of a blend of 25 wt % of cast carbide having a particle size from about 44 micrometers (325 mesh) to about 63 micrometers (230 mesh) and 75% of ultra-coarse tungsten carbide having a particle size of about 44 micrometers (325 mesh) with addition of a second fraction of ultra-coarse tungsten carbide and a second fraction of cast carbide, in accordance with various aspects of the present disclosure.

The variation of tap density of tri modal blends prepared from mixing the bi modal Blend 3 (50 wt. % CC with a particle size of −60/+120 mesh and 50 wt. % UC-WC with a particle size of −325 mesh) and 5-25 wt. % of UC-WC powder fractions (particle sizes of: −170/+230&−230/+325 mesh) and CC powder fractions (particle sizes of: −80/+170 &−120/+230 mesh) is shown in FIG. 8. In some aspects, the tap density of bi modal Blend 3 powders decreased with addition of a UC-WC blend having a particle size of −170/+230 mesh and a particle size of −230/+325 mesh size. In other aspects, the tap density of the bi modal Blend 3 powder decreased with an addition of a powder fraction of CC with a particle size of −120/+230 mesh. The tap density of bi modal Blend 3 powder increased from 11.2 g/cm$^3$ to 11.5 g/cm$^3$ with addition of 10 wt. %. CC with a particle size of −80/+170 mesh. The tap density of the powder decreased with the addition of above 10 wt. % of CC having a particle size of −80/+170 mesh.

Figure 9:
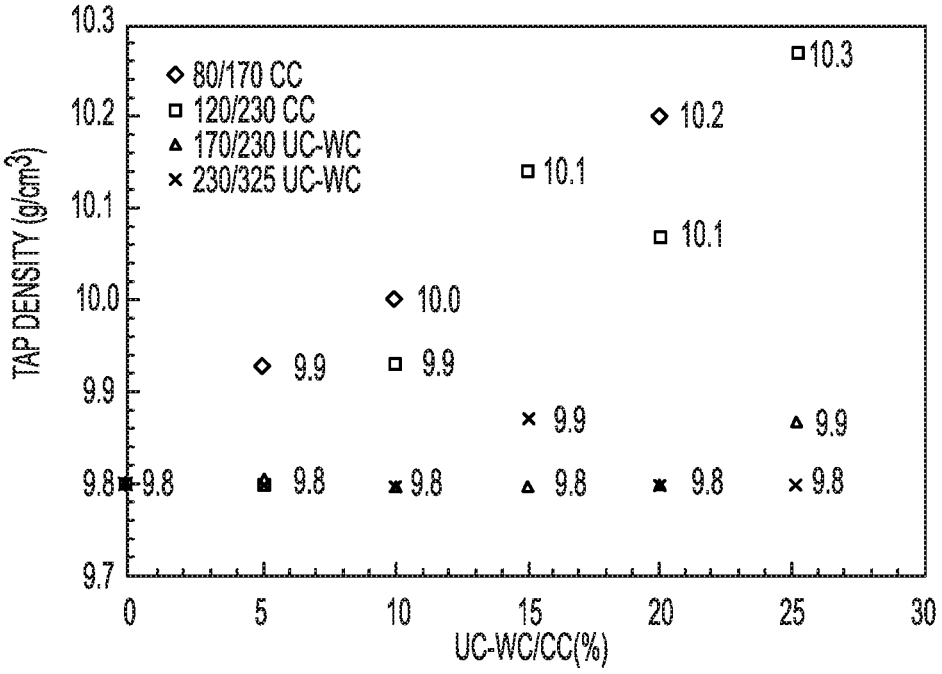
FIG. 9 depicts variations in tap density of a tri modal blend prepared from mixing bi modal Blend 4 and 5-25 wt. % of UC-WC powder fractions and CC powder fractions, in accordance with various aspects of the present disclosure.

The variation of tap density of tri modal blends prepared from mixing bi modal Blend 4 (25 wt. % CC with a particle size of −230+/325 mesh and 75 wt. % UC-WC with a particle size of −325 mesh) and 5-25 wt. % of UC-WC powder fractions (particle sizes of: −170/+230&−230/+325 mesh) and CC powder fractions (particle sizes of: −80/+170 & −120/+230 mesh) is shown in FIG. 9. In some aspects, the tap density of bi modal Blend 4 powder showed negligible change due to the addition of UC-WC powder fractions having a particle size of −170/+230&−230/+325 mesh. In yet other aspects, however, the tap density of the bi modal Blend 4 powder increased with addition of CC powder fractions having a particle size of −80/+170 &−120/+230 mesh. A maximum tap density of 10.3 g/cm$^3$ was obtained by adding 25 wt. % of CC powder having a particle size of −120/+230 mesh to the bi modal powder.

The summary of the optimized blend composition and the exhibited tap density of bi modal powder are shown in Table 1. The highest tap density among the bi modal powders was obtained for Blend 3.

TABLE 1

Summary of the optimized blend composition and exhibited tap density of bi modal powder.

| Sample | Composition | Tap density (g/cm$^3$) |
|---|---|---|
| Blend 1 | 40 wt. % UC-WC −80/+120 and 60 wt. % UC-WC −325 mesh | 10.6 |
| Blend 2 | 80 wt. % CC −60/+120 and 20 wt. % CC −230/+325 mesh | 10.4 |
| Blend 3 | 50 wt. % CC −60/+120 and 50 wt. % UC-WC −325 mesh | 11.2 |
| Blend 4 | 25 wt. % CC −230/+325 and 75 wt. % UC−325 mesh | 9.8 |

The summary of the optimized blend composition and the exhibited tap density of tri modal powder are shown in Table 2. The highest tap density of 11.5 g/cm$^3$ was observed for tri modal blend obtained by adding 10 wt. % of CC 80/170 powder fraction to optimized bi modal 3 blend.

TABLE 2

Summary of the optimized blend composition and exhibited tap density of tri modal powder.

| Sample | Base bi modal blend | Composition | Tap density (g/cm$^3$) |
|---|---|---|---|
| Blend 5 | Optimized Blend 1 | 40 wt. % UC-WC−80/+120 mesh and 60 wt. % UC-WC −325 mesh, 15 wt. % −80/+170 CC mesh | 10.8 |
| Blend 6 | Optimized Blend 2 | 80 wt. % CC −60/+120 and 20 wt. % CC −230+/325, 25 wt. % −325 UC-WC mesh | 10.8 |
| Blend 7 | Optimized Blend 3 | 50 wt. % CC −60/+120 and 50 wt. % UC-WC −325 mesh, 10 wt. %. CC −80/+170 mesh | 11.5 |

TABLE 2-continued

Summary of the optimized blend composition and exhibited tap density of tri modal powder.

| Sample | Base bi modal blend | Composition | Tap density ($g/cm^3$) |
|---|---|---|---|
| Blend 8 | Optimized Blend 4 | 25 wt. % CC −230/+325 and 75 wt. % UC−325 mesh, 25 wt. % of −120/+230 CC mesh | 10.3 |

Infiltration Density

Figure 10:
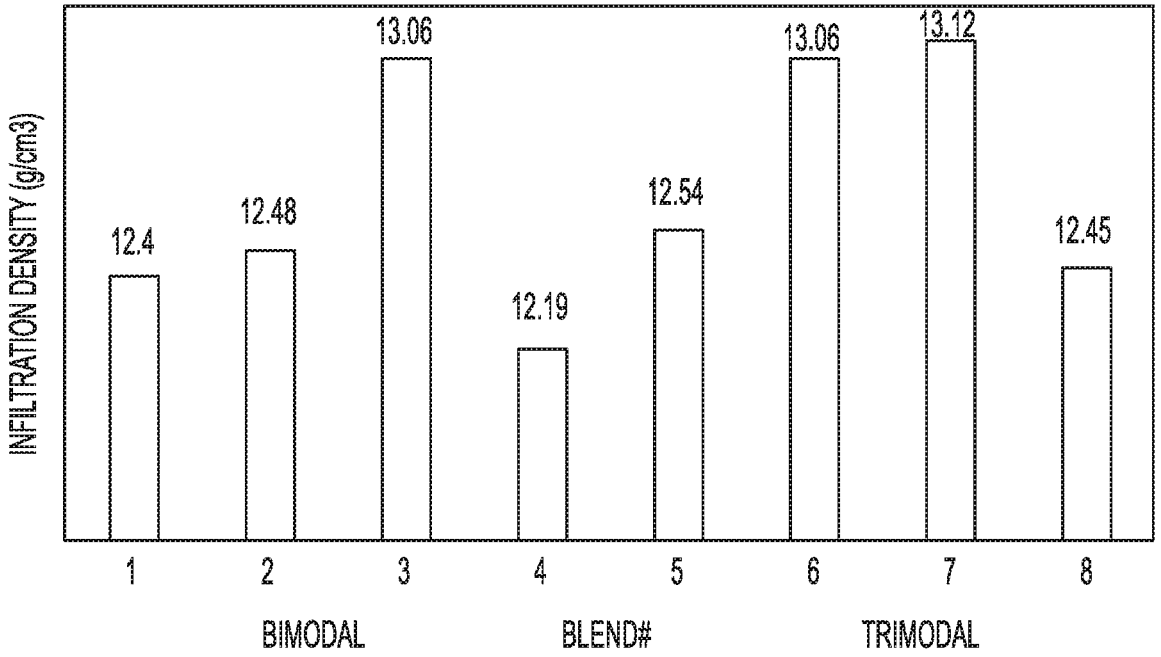
FIG. 10 depicts infiltration density of optimized bi-modal and tri-modal blends prepared, in accordance with various aspects of the present disclosure.

The obtained infiltration density of the optimized bi modal and tri modal blends listed in Table 1 and Table 2 is shown in FIG. 10. The obtained infiltration density of the samples followed the tap density trend of the body powders. The blends showing highest tap density i.e. bi modal Blend 3 and tri modal Blend 7 showed densities greater than 13.0 $g/cm^3$ on infiltration. Tri modal Blend 6 also showed a high infiltration density of 13.06 $g/cm^3$ even though the tap density of the blend was only 10.8 $g/cm^3$.

Figure 11:
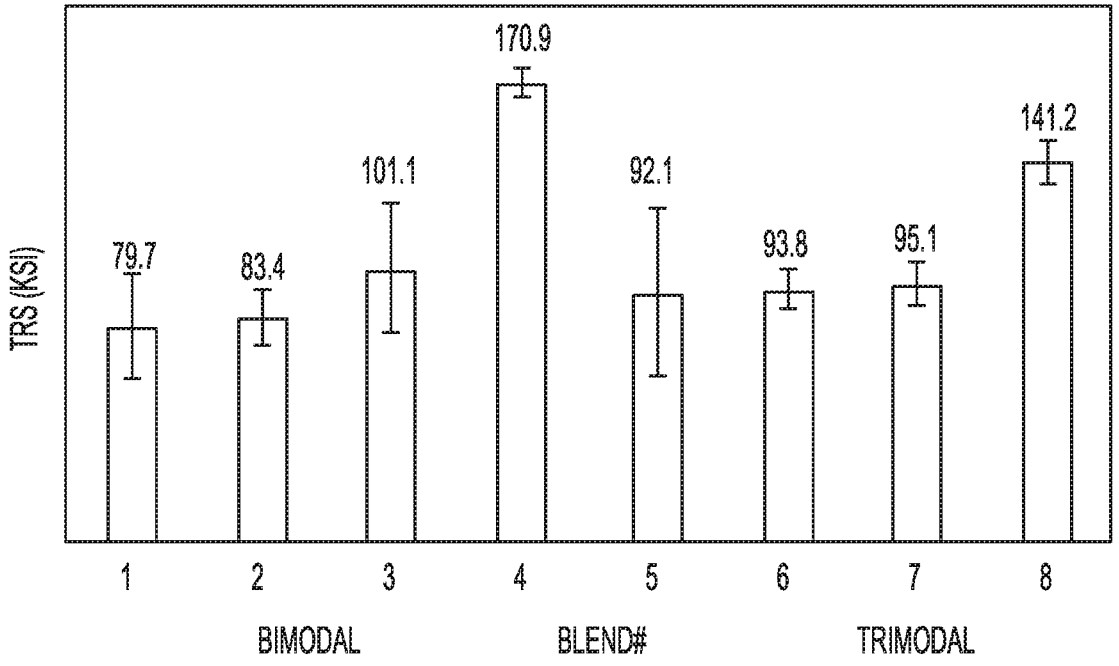
FIG. 11 depicts Transverse Rupture Strength (TRS) values of infiltrated samples made from bi-modal and tri-modal blends, in accordance with various aspects of the present disclosure.

Strength Evaluation:

The infiltrated samples of the optimized bi modal and tri modal blends listed in Table 1 and Table 2 were evaluated for strength and wear evaluation. The strength's displayed by the infiltrated blends are shown in FIG. 11. All the blends except for Blend 4 and Blend 8 showed strengths less than 100 KSI. Among bi modal blends, Blend 4 showed the highest strength of 170.9 KSI. The high strength displayed by bi modal Blend 4 is not surprising as the blend was made with smaller size of UC-WC and CC. The strengths of the infiltrated samples increased with decrease in particle size of the UC-WC and CC powders. Among the tri modal blends, Blend 8 prepared from base bi modal Blend 4 showed the highest strength. Interestingly, no correlation between the high infiltration or tap density and the strength was observed. In other words, as one of ordinary skill in the art would readily appreciate the results showed that the high strength is not inherent to the blends exhibiting the highest infiltration and tap densities.

Figure 12:
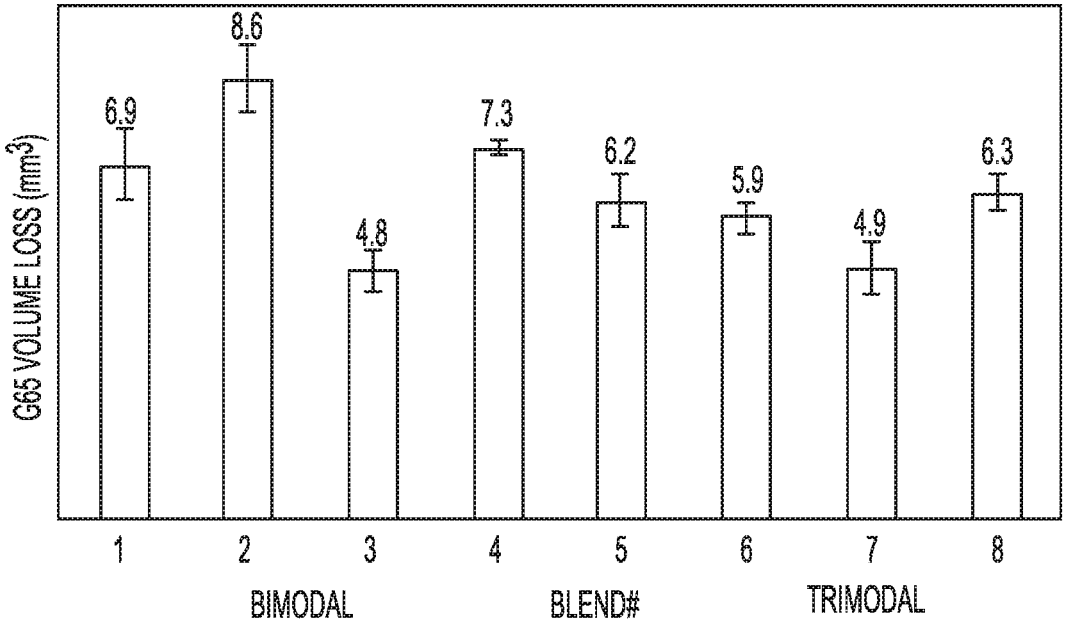
FIG. 12 depicts volume loss measured according to ASTM G65 for infiltrated samples made from bi-modal and tri-modal blends, in accordance with various aspects of the present disclosure.

Erosion (G65) Resistance:

The volume loss during G65 wear testing of the bi modal and tri modal blends is shown in FIG. 12. It was shown that the blends showing the high tap and infiltration density i.e. bi modal Blend 3 and tri modal Blend 7 showed the lowest volume loss during G65 testing. The blends showed a volume loss of 4.8-4.9 $mm^3$ during G65 testing. The volume loss of the bi modal and tri modal blends were 50% lower than GM6 (9.8 $mm^3$) and 20% lower than GTP 90 (6.1 $mm^3$) body powder blends. All the remaining bi and tri modal blends showed a volume loss greater than 6.0 $mm^3$. The only exception is tri modal Blend 5 which showed a volume loss of 5.9 $mm^3$. All the bi modal and tri modal blends in the study showed lower volume loss than 9.8 $mm^3$ suggesting superior erosion resistance than the standard GM6 blends.

Figure 13:
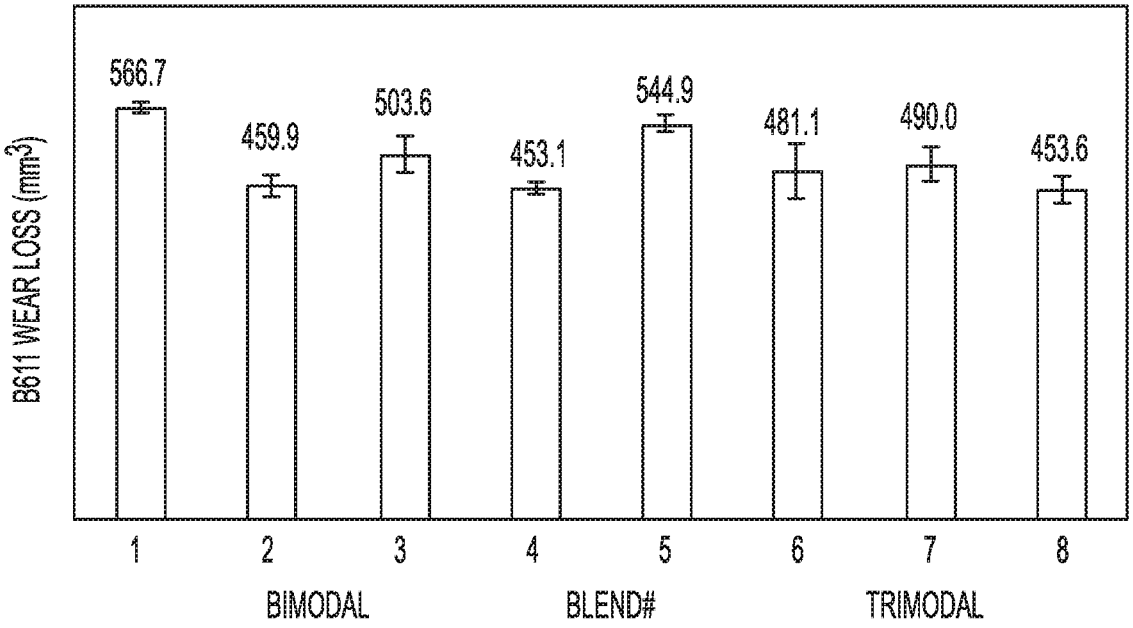
FIG. 13 depicts volume loss measured according to ASTM B611 for infiltrated samples made from bi-modal and tri-modal blends, in accordance with various aspects of the present disclosure.

Abrasion (B611) Resistance:

The volume loss during B611 wear testing of the bi modal and tri modal blends is shown in FIG. 13. The bi modal Blend 1 and tri modal Blend 5 showed the highest volume loss of 566.7 and 544.9 $mm^3$ during B611 wear testing. All the remaining blends showed volume loss above 450 $mm^3$ during B611 wear testing. The standard GM6 and GTP 90 show a volume loss of 382.4 and 473.6 $mm^3$. All the bi modal and tri modal developed in the study showed lower abrasion resistance than GM6 body powder. Bi modal Blend 2, bi modal Blend 4 and tri modal Blend 8 showed superior abrasion resistance than GTP 90 body powder.

It was shown that among bi modal blends, the blend (bi modal Blend 3) containing 50 wt. % CC with a particle size of −60/+120 mesh and 50 wt. % of UC-WC powder fractions having a particle size of −325 mesh showed the highest tap density of 11.20 $g/cm^3$. Interestingly, the tap density of this bi modal blend was further increased from 11.20 $g/cm^3$ to 11.54 $g/cm^3$ with addition of 10 wt. % of the powder fraction CC having a particle size of 80/120 to the blend (tri modal Blend 7). The bi modal Blend 3 and tri modal Blend 7 showed a very high infiltration density of 13.06 $g/cm^3$ and 13.12 $g/cm^3$ respectively. The volume loss of the bi modal Blend 3 and tri modal Blend 7 during G65 wear testing was significantly lower at 4.84 $mm^3$ and 4.89 $mm^3$ respectively. The observed volume loss of the blends were 50% lower than GM6 (9.8 $mm^3$) and 20% lower than GTP 90 (6.1 $mm^3$) body powder blends.

In some aspects, while the bi modal Blend 3 exhibited high tap and infiltration densities, it also exhibited low TRS values of 101.1±24.5 KSI. As one of ordinary skill in the art can readily appreciate a minimum TRS of 120 KSI is required for introducing the body powder blends with good erosion resistance (G65 volume loss <6 $mm^3$) to the market.

In certain aspects, to improve the minimum TRS of bi modal Blend 3, various bi-modal Blend 3 has been further modified by adding 1, 3 and 5 wt. % Ni, Fe and steel alloying elements. Addition of alloying elements did not result in improving the minimum TRS value of bi modal Blend 3 above 120 KSI. In yet other aspects, also the addition of poly G to the blends also did not result in significant improvement of the strength for most of the blends. The blends with poly G addition showed G65 volume loss much higher than 6 $mm^3$.

In yet other aspects, to improve the minimum TRS value, the base composition of bi modal Blend 3 was modified by changing the fraction of UC-WC with a particle size of −325 to 60 wt. % and 70 wt. %. In certain aspects, the 60 wt. % of UC-WC fraction with a particle size of −325 mesh and 40 wt. % of CC fraction with a particle size of 60/120 mesh identified as bi modal 60/40 Blend 3. In yet other aspects, the 70 wt. % of UC-WC fraction with a particle size of −325 mesh and 30 wt. % of CC fraction with a particle size of 60/120 mesh identified as bi modal 70/30 Blend 3. In still further aspects, additional blends were prepared by adding 1 wt. % Ni/1 wt. % Fe/1 wt. % steel to the bi modal 60/40 Blend 3 and bi modal 70/30 Blend 3 base powders.

In certain aspects, the TRS values of bi modal 60/40 Blend 3 mixed with 1 wt. % Ni and bi modal 60/40 Blend 3 mixed with 1 wt. % Fe showed minimum TRS values greater than 120 KSI. Similarly, the TRS values of the bi modal 70/30 Blend 3 mixed with 1 wt. % Ni and bi modal 70/30 Blend 3 mixed with 1 wt. % steel showed minimum TRS values greater than 120 KSI. In still further aspects, the average volume loss of blends made from bi modal 60/40 Blend 3 was lower than 6 $mm^3$ during G65 evaluation. In yet other aspects, blends made with bi modal 70/30 Blend 3 composition exhibited inferior erosion resistance i.e. more volume loss during G65 testing than blends made from bi modal 60/40 Blend 3 composition.

A large variation was observed in the TRS and G65 data for modified bi modal Blend 3 with alloying elements. The large variation in the values is understood to be due to the high amount of UC-WC fraction having a particle size of −325 mesh in the blends. Without wishing to be bound by theory, it hypothesized that since the UC-WC powders having a particle size of −325 mesh are cohesive in nature, they have high tendency to segregate during filling the powder in the mold prior to infiltration. The bi modal 3 and modified bi modal 3 blends in the study were tapped for only 5 cycles prior to infiltration. It was shown that in some aspects, tapping of 50 cycles is required to disperse the UC-WC fraction having a particle size of −325 mesh uniformly in the mold.

In certain aspects, to improve the TRS values, bi modal 60/40 Blend 3 was mixed with 1 wt. % Ni, 1 wt. % Fe, and 1 wt. % steel at increased tapping of 50 cycles.

In certain aspects, the blends with Ni and steel additions tapped for 50 cycles showed minimum TRS value greater than 120 KSI. In still further aspects, the bi modal 60/40 Blend 3 with additions of 1 wt. % Ni/1 wt. % Fe/1 wt. % steel, after tapping for 50 cycles, showed 54% and 27% lower volume losses during G65 testing than standard GM 6 and GTP 90 blends. The blends also showed approximately 39% lower volume loss during G76 testing than standard GM6 and GTP 90 blends. The bi modal 60/40 Blend 3 comprising 1 wt. % Ni/1 wt. % Fe/1 wt. % steel (after adequate tapping) were identified as appropriate compositions for high strength erosion resistant "GTP-ER" body powders.

Experimental Procedure

Infiltrated samples for strength and wear evaluation were made from blends containing UC-WC, CC and alloying powders. The powder mix is initially poured into the graphite mold and tapped for five cycles. In some exemplary aspects, the powder mix was tapped for 50 cycles. On the top of the powder mix, the Cu-24% Mn-15% Ni-8% Zn granules and flux were placed in the graphite mold. The graphite mold is then heated in a furnace at 1200° C. for 1 h in air to infiltrate the Cu alloy into the powders. After infiltration, the graphite mold is broken and the samples used for strength and wear testing were obtained. The infiltrated samples for wear evaluation were further cut and machined prior to testing. The strength of the infiltrated samples was measured using a three point bend test. The erosion and abrasion properties of infiltrated samples were measured using ASTM G65 and ASTM B611 methods.

Alloy Additions to Bi Modal Blend 3

Figure 14:
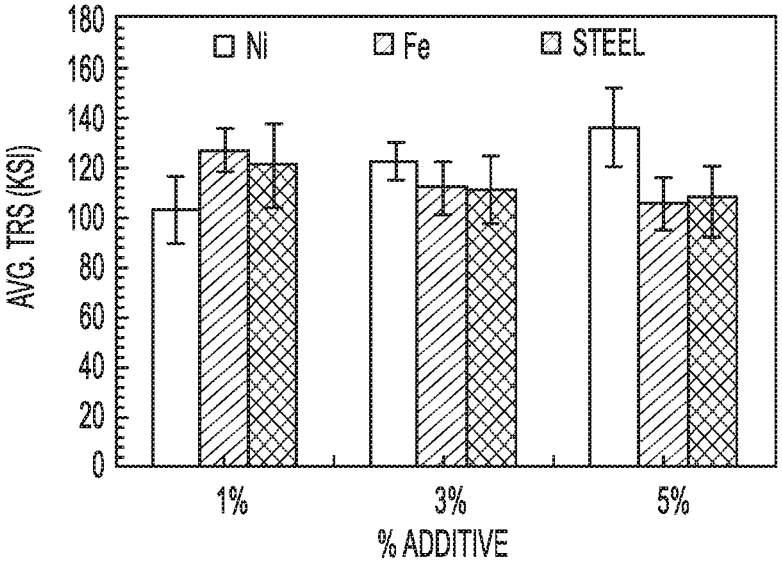
FIG. 14 depicts average Transverse Rupture Strength (TRS) values of infiltrated samples made from bi-modal blend comprising various fractions of Ni/Fe/Steel alloying elements, in accordance with various aspects of the present disclosure.
Figure 15:
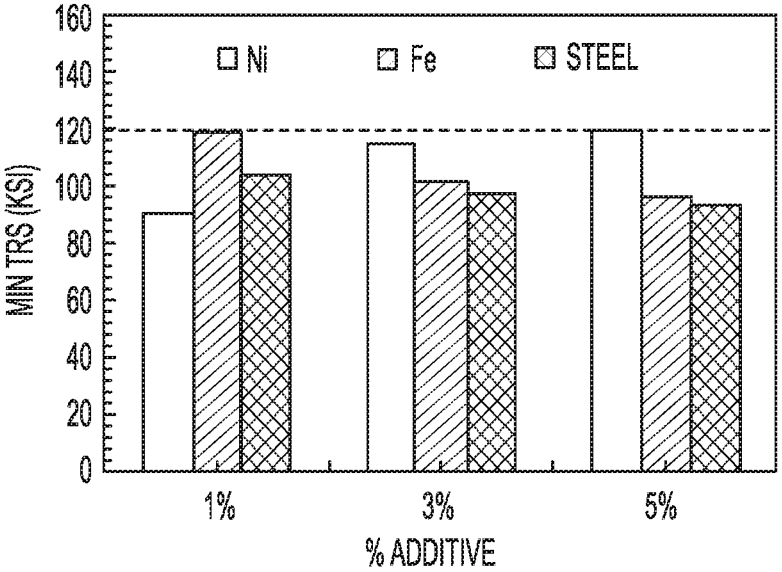
FIG. 15 depicts minimal Transverse Rupture Strength (TRS) values of infiltrated samples made from bi-modal blend comprising various fractions of Ni/Fe/Steel alloying elements, in accordance with various aspects of the present disclosure.

Initial studies to improve the minimum TRS of bi modal Blend 3 (original Blend 3 comprising 50 wt. % of UC-WC fraction having a particle size of −325 mesh and 50 wt. % of CC fraction having a particle size of 60/120 mesh) were carried out by adding 1, 3 and 5 wt. % Ni/Fe/steel alloying elements. The obtained TRS values of the blends are shown in Table 3. The plot showing the variation of average TRS values and minimum TRS value of the blends is shown in FIG. 14 and FIG. 15 respectively. The TRS values of the bi modal Blend 3 increased with increase in Ni content. The TRS values of the bi modal Blend 3 increased from 103.3±13.4 to 135.5±16.7 KSI with increase in Ni content from 1 to 3 wt. %. However, surprisingly, the trend was opposite in the case of Fe and steel additions. In this case, the average TRS values decreased with increase in Fe and steel additions. The TRS values of the bi modal Blend 3 decreased from 126.5±8.6 to 105.6±9.7 KSI with increase in Fe content from 1 to 3 wt. %. Similarly, the TRS values of the bi modal Blend 3 decreased from 121±17.3 to 107±14.5 KSI with increase in steel content from 1 to 3 wt. %.

TABLE 3

TRS data of bi modal 3 blends with addition 1, 3 and 5 wt. % Ni/Fe/steel alloying elements.

| | TRS (KSI) | | | |
|---|---|---|---|---|
| Grade | Avg. | Std. | Max. | Min. |
| Bimodal-3 | 101.1 | 24.5 | 125.6 | 76.6 |
| Bimodal 3 + 1% Ni | 103.3 | 13.4 | 116.7 | 89.9 |
| Bimodal 3 + 3% Ni | 122.3 | 7.7 | 130.0 | 114.6 |
| Bimodal 3 + 5% Ni | 135.5 | 16.7 | 152.2 | 118.8 |
| Bimodal 3 + 1% Fe | 126.5 | 8.6 | 135.1 | 117.9 |
| Bimodal 3 + 3% Fe | 111.8 | 10.6 | 122.4 | 101.2 |
| Bimodal 3 + 5% Fe | 105.6 | 9.7 | 115.3 | 95.9 |
| Bimodal 3 + 1% steel | 121 | 17.3 | 138.3 | 103.7 |
| Bimodal 3 + 3% steel | 111.1 | 13.7 | 124.8 | 97.4 |
| Bimodal 3 + 5% steel | 107.0 | 14.5 | 121.5 | 92.5 |

Figure 16:
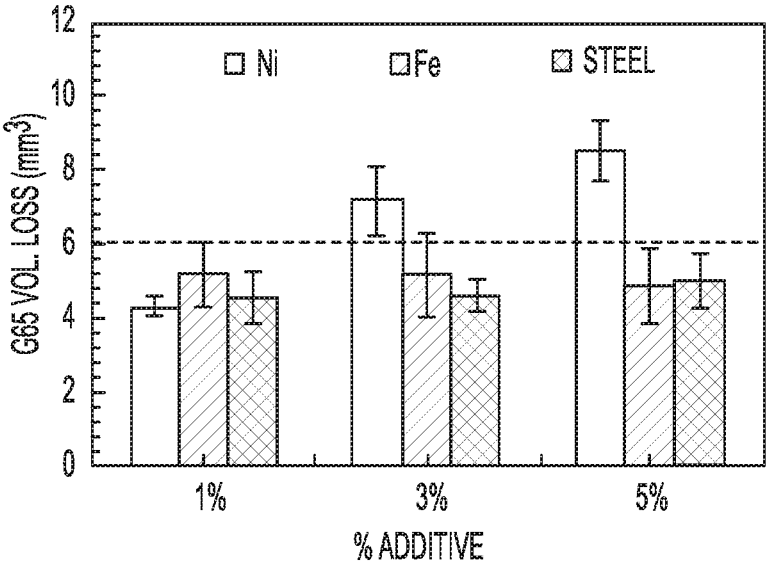
FIG. 16 depicts volume loss measured according to ASTM G65 for infiltrated samples made from bi-modal blend comprising various fractions of Ni/Fe/Steel alloying elements, in accordance with various aspects of the present disclosure.

The volume loss of blends during G65 erosion and B611 abrasion wear evaluation is shown in Table 4. The volume loss of the bi modal Blend 3 increased from 4.31±0.25 to 8.55±0.82 $mm^3$ with increase in Ni content from 1 to 5 wt. %. The amount of Fe and steel did not show any significant change in volume loss of the blends during G65 testing (FIG. 16). Addition of alloying metals increased the abrasion resistance (low B611 volume loss) of bi modal Blend 3. The volume loss of the blends during B611 testing decreased with an increase in amounts of Ni, Fe and steel.

TABLE 4

Volume loss of bi modal 3 blends with addition 1, 3 and 5 wt. % Ni/Fe/steel during G65 and B611 wear evaluation.

| | G65 vol. loss ($mm^3$) | | B611 vol. loss ($mm^3$) | |
|---|---|---|---|---|
| Grade | Avg. | Std. | Avg. | Std. |
| Bimodal-3 | 4.84 | 0.40 | 735 | 24.37 |
| Bimodal 3 + 1% Ni | 4.31 | 0.25 | 693.25 | 50.00 |
| Bimodal 3 + 3% Ni | 7.21 | 0.92 | 600.97 | 53.45 |
| Bimodal 3 + 5% Ni | 8.55 | 0.82 | 556.56 | 19.77 |
| Bimodal 3 + 1% Fe | 5.19 | 0.85 | 686.34 | 27.81 |
| Bimodal 3 + 3% Fe | 5.20 | 1.10 | 644.06 | 34.13 |
| Bimodal 3 + 5% Fe | 4.88 | 1.00 | 600.26 | 18.42 |
| Bimodal 3 + 1% steel | 4.55 | 0.69 | 698.75 | 25.22 |
| Bimodal 3 + 3% steel | 4.63 | 0.44 | 627.08 | 21.58 |
| Bimodal 3 + 5% steel | 5.04 | 0.78 | 572.11 | 8.83 |

Addition of Poly G to Bi Modal 3 Alloy Blends:

A large variation i.e. high standard deviation in TRS values was observed in the blends made from mixing alloying elements to bi modal Blend 3 powders. The large variation in the TRS values was attributed to the segregation of different powders in the blends. Further experiments were carried out with the addition of poly G to the bi modal 3 blends with alloying elements. The addition of poly G was hypothesized to minimize the segregation of powders resulting in improvement of TRS values of the blends. The TRS values of the blends with poly G addition are shown in Table 5.

TABLE 5

TRS data of bi modal 3 blends with poly G.

| | TRS (KSI) | | | |
|---|---|---|---|---|
| Grade | Avg. | Std. | Max. | Min. |
| Bimodal-3 | 107.9 | 11.9 | 119.5 | 93.1 |
| Bimodal 3 + 1% Ni | 119.1 | 13.39 | 140.8 | 100.6 |

TABLE 5-continued

TRS data of bi modal 3 blends with poly G.

| Grade | TRS (KSI) Avg. | Std. | Max. | Min. |
|---|---|---|---|---|
| Bimodal 3 + 3% Ni | 123.5 | 8.45 | 132.0 | 115.1 |
| Bimodal 3 + 5% Ni | 134.9 | 8.31 | 143.2 | 126.6 |
| Bimodal 3 + 1% steel | 114.3 | 13.87 | 130.2 | 97.5 |
| Bimodal 3 + 3% steel | 127.9 | 5.09 | 134.7 | 120.7 |
| Bimodal 3 + 5% steel | 116.7 | 5.36 | 123 | 110.8 |

Figure 17:
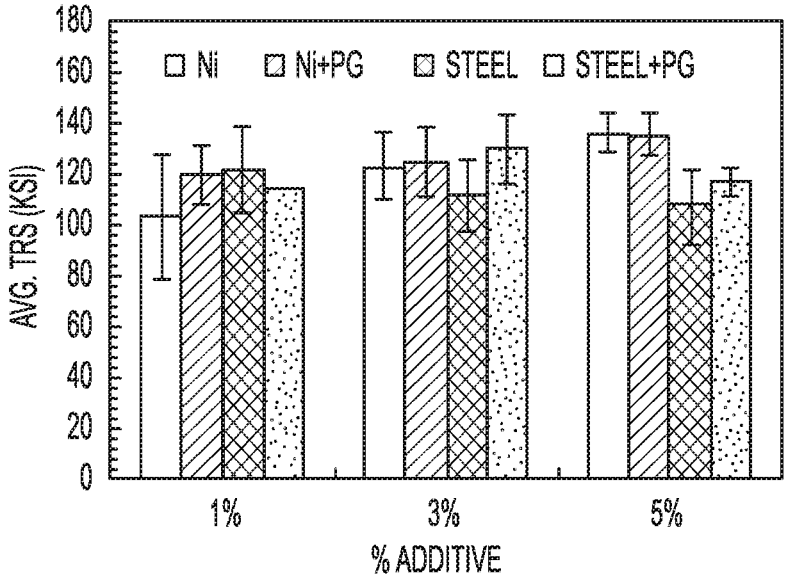
FIG. 17 depicts a comparison of average Transverse Rupture Strength (TRS) values of infiltrated samples made from bi-modal blend with and without poly G, in accordance with various aspects of the present disclosure.
Figure 18:
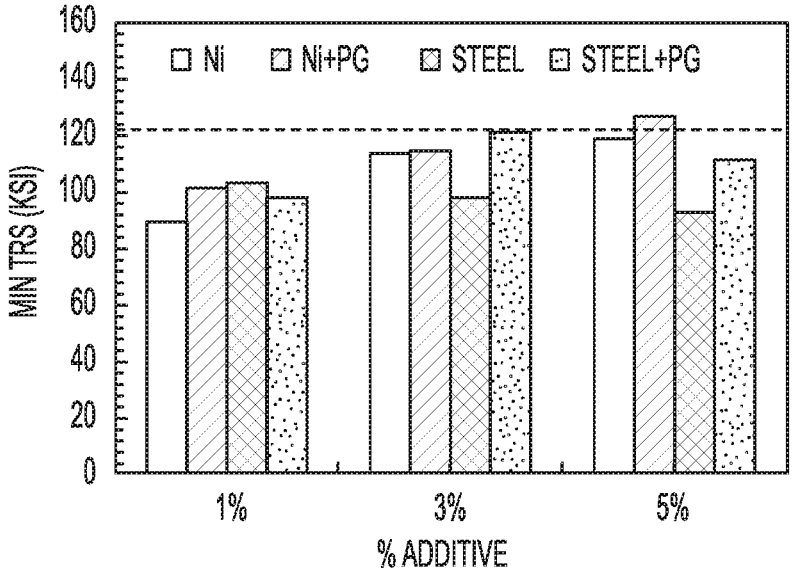
FIG. 18 depicts a comparison of minimal Transverse Rupture Strength (TRS) values of infiltrated samples made from bi-modal blend with and without poly G, in accordance with various aspects of the present disclosure.

The plot showing the comparison of average TRS and minimum TRS for the blends with and without poly G addition is shown in FIG. 17 and FIG. 18. The data clearly shows no improvement in TRS values of the blend with the addition of poly G. bi modal Blend 3 with 5 wt. % Ni with addition of poly G showed a minimum strength of 126.6 KSI. Similarly bi modal 3 blend and 3 wt. % steel with addition of poly G showed a minimum strength of 120.7 KSI.

Figure 19:
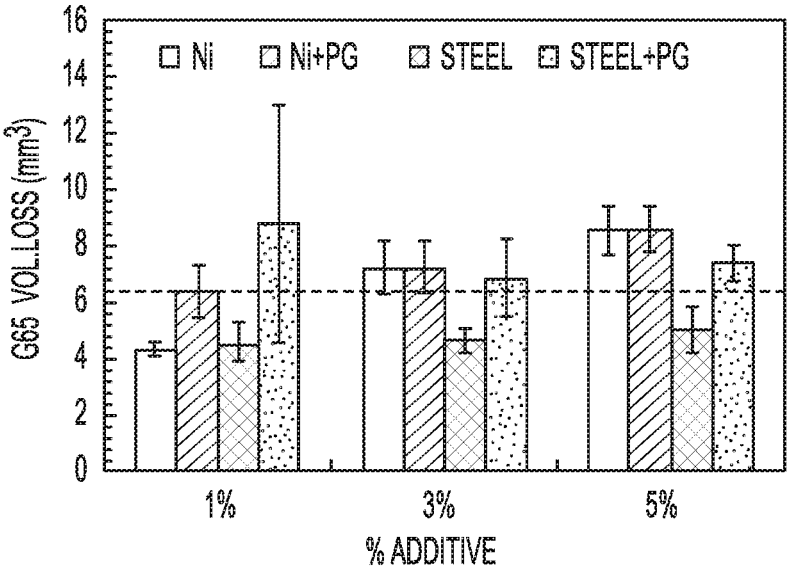
FIG. 19 depicts comparison of a volume loss measured according to ASTM G65 for infiltrated samples made from bi-modal blend with and without poly G, in accordance with various aspects of the present disclosure.

The comparison of volume loss of the blends with and without addition of poly G is shown in FIG. 19. The plot clearly shows the adverse effect of poly G addition in lowering the erosion resistance of the blends. The volume loss of the blends increased with poly G addition. The blends with poly G addition showed volume loss higher than 6 $mm^3$. The poor erosion resistance of the blends negated addition of poly G as an option to improve the TRS value of bi modal Blend 3.

Figure 20:
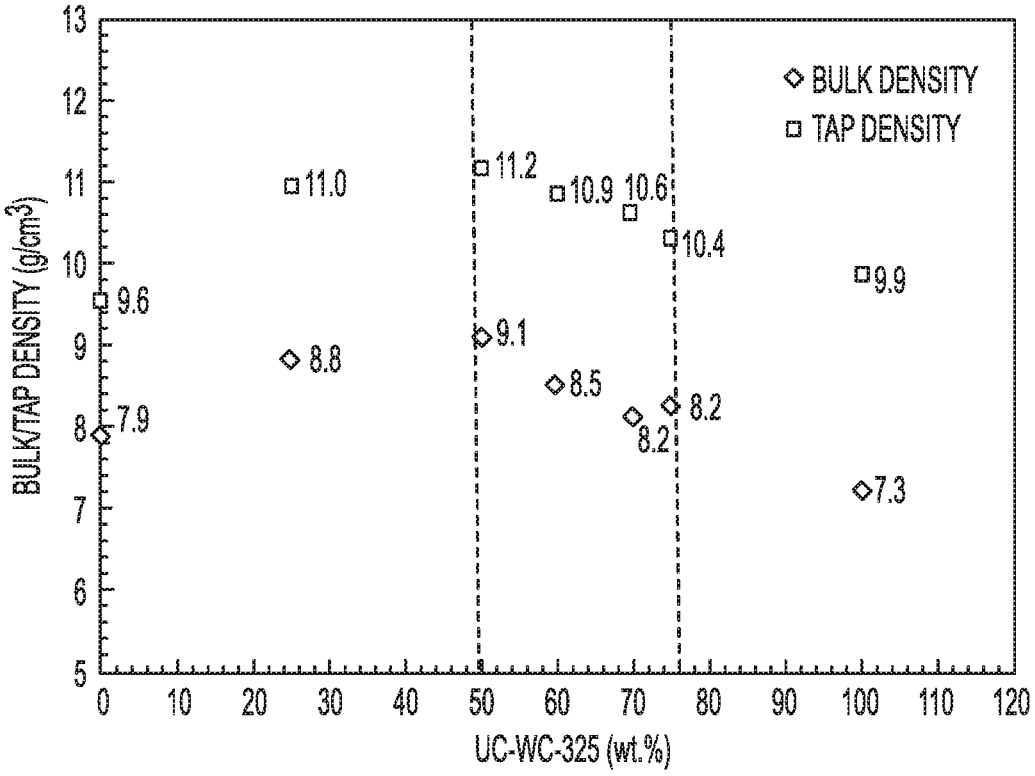
FIG. 20 depicts the variation of bulk/tap density of bi modal mixtures of ultra-coarse tungsten carbide having a particle size of about 44 micrometers (325 mesh) and cast carbide having a particle size from about 125 micrometers (120 mesh) to about 250 micrometers (60 mesh), in accordance with various aspects of the present disclosure.

Modified Bi Modal 3 Blends:

In yet other aspects, to further improve the TRS value of the blends, the base bi modal Blend 3 was modified by changing the ratio of the UC-WC and CC in the composition. In the modified bi modal Blend 3, the amount UC-WC fraction with a particle size of −325 mesh was increased to 60 wt. % and 70 wt. %. The variation of bulk/tap density of the bi modal mixtures of −325UC-WC and 60/120CC with the modified bi modal Blend 3 (shown between dashed lines) is shown in FIG. 20. The tap and infiltration density of the base and modified bi modal Blend 3 is shown in Table 6. The tap and infiltration density of the blends decreased with an increase in amount of fraction UC-WC having a particle size of −325 mesh.

TABLE 6

Tap and infiltration density of the base and modified bi modal 3 blends.

| Blend | Composition | Tap density (g/cm3) | Infiltration density (g/cm3) |
|---|---|---|---|
| Bi modal 3 | 50% −325 UC WC + 50% 60/120 CC | 11.2 | 13.1 |
| 60-40 Bi modal 3 | 60% −325 UC WC + 40% 60/120 CC | 10.9 | 12.9 |
| 70-30 Bi modal 3 | 70% −325 UC WC + 30% 60/120 CC | 10.6 | 12.7 |

The minimum TRS values of the modified bi modal Blend 3 were less than 120 KSI. The TRS value of the bi modal 60/40 Blend 3 was 118.8±16.1 KSI with a minimum value of 94.5 KSI. The TRS value of the bi modal 70/30 Blend 3 was 126±9.6 KSI with a minimum value of 115.1 KSI. The TRS value of base bi modal Blend 3 was 101.1±24.5 KSI with a minimum value of 76.6 KSI. In certain aspects, the modified bi modal Blend 3 showed higher average and minimum strength than the base bi modal Blend 3. The bi modal 70/30 Blend 3 showed a higher average and minimum strength than the bi modal 60/40 Blend 3.

Figure 21:
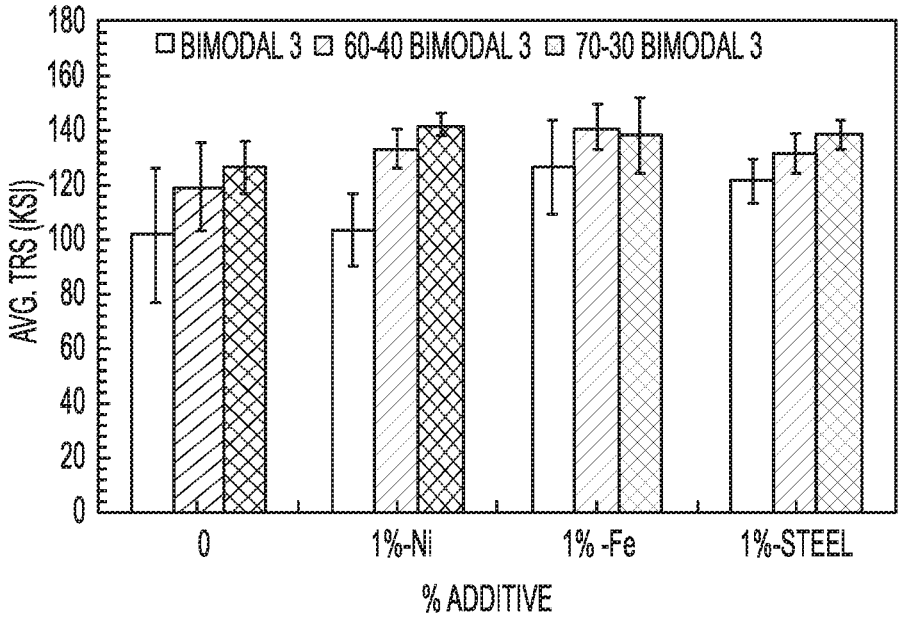
FIG. 21 depicts average Transverse Rupture Strength (TRS) values of infiltrated samples made from bi-modal blend comprising 50-70 wt % of ultra-coarse tungsten carbide having a particle size of 44 micrometers (325 mesh) and 30-50 wt % of cast carbide having a particle size of 125 micrometers (120 mesh) to about 250 micrometers (60 mesh) containing various alloying elements, in accordance with various aspects of the present disclosure.

Additional blends to improve the minimum TRS value above 120 KSI were prepared by adding 1 wt. % Ni, 1 wt. % Fe and 1 wt. % steel to the bi modal 60/40 Blend 3 and bi modal 70/30 Blend 3 powders. The TRS data of the blends is displayed in Table 7. The average TRS of the blends with the addition of various alloying elements is shown in FIG. 21. The average TRS values of the modified bi modal 3 blends increased with the addition of alloying elements. Powder blends of the bi modal 60/40 Blend 3 mixed with 1 wt. % Ni/1 wt. % Fe showed minimum TRS values greater than 120 KSI. Similarly TRS values of the bi modal 70/30 Blend 3 mixed with 1 wt. % Ni/1 wt. % steel showed minimum TRS values greater than 120 KSI.

TABLE 7

TRS data of the modified bi modal 3 blends containing various alloying elements.

| Sample | Additive | Number of samples | TRS (KSI) Avg. | Std. | Max. | Min. |
|---|---|---|---|---|---|---|
| 60-40 Bimodal 3 | 0 | 6 | 118.8 | 16.1 | 132.0 | 94.5 |
| 60-40 Bimodal 3 | 1%-Ni | 6 | 132.7 | 7.1 | 144.5 | 125.0 |
| 60-40 Bimodal 3 | 1%-Fe | 18 | 140.6 | 8.7 | 156.0 | 128.0 |
| 60-40 Bimodal 3 | 1%-Steel | 18 | 131.3 | 7.2 | 138.2 | 107.5 |
| 70-30 Bimodal 3 | 0 | 6 | 126.0 | 9.6 | 139.6 | 115.1 |
| 70-30 Bimodal 3 | 1%-Ni | 6 | 141.5 | 4.1 | 145.2 | 134.0 |
| 70-30 Bimodal 3 | 1%-Fe | 12 | 137.7 | 13.5 | 155.9 | 114.4 |
| 70-30 Bimodal 3 | 1%-Steel | 18 | 137.8 | 5.7 | 152.0 | 126.9 |

Figure 22:
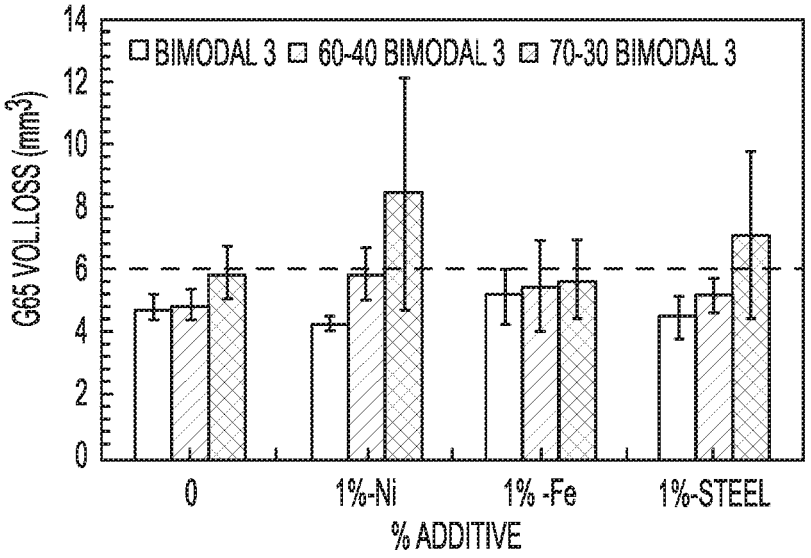
FIG. 22 depicts a volume loss measured according to ASTM G65 for infiltrated samples made from bi-modal blend comprising 50-70 wt % of ultra-coarse tungsten carbide having a particle size of 44 (325 mesh) micrometers and 30-50 wt % of cast carbide having a particle size of 125 (120 mesh) micrometer to about 250 (60 mesh) micrometers containing various alloying elements, in accordance with various aspects of the present disclosure.

The average volume loss of the base and modified bi modal 3 blends containing various alloying elements during G65 testing is shown in Table 8 and FIG. 22. The average G65 volume loss of the bi modal 60/40 Blend 3 and the bi modal 60/40 Blend 3 comprising various alloying elements was less than 6 $mm^3$. The average G65 volume loss of the bi modal 70/30 Blend 3 and the bi modal 70/30 Blend 3 mixed with 1 wt. % Fe was less than 6 $mm^3$. However, the average G65 volume loss of the bi modal 70/30 Blend 3 mixed with 1 wt. % Ni and the bi modal 70/30 Blend 3 mixed with 1 wt. % steel was more than 6 $mm^3$. Blends made with the bi modal 70/30 Blend 3 composition exhibited inferior erosion resistance i.e. more volume loss during G65 testing than blends made from the bi modal 60/40 Blend 3 composition.

TABLE 8

Volume loss data of the base and modified bi modal 3 blends containing various alloying elements during G65 testing.

| Sample | Additive | Number of samples | G65 ($mm^3$) Avg. | Std. |
|---|---|---|---|---|
| 60-40 Bimodal 3 | 0 | 4 | 4.92 | 0.48 |
| 60-40 Bimodal 3 | 1%—Ni | 4 | 5.90 | 0.80 |
| 60-40 Bimodal 3 | 1%—Fe | 15 | 5.52 | 1.42 |
| 60-40 Bimodal 3 | 1%—Steel | 12 | 5.23 | 0.56 |
| 70-30 Bimodal 3 | 0 | 4 | 5.94 | 0.83 |
| 70-30 Bimodal 3 | 1%—Ni | 4 | 8.42 | 3.73 |
| 70-30 Bimodal 3 | 1%—Fe | 7 | 5.72 | 1.24 |
| 70-30 Bimodal 3 | 1%—Steel | 8 | 7.17 | 2.62 |

Figure 23:
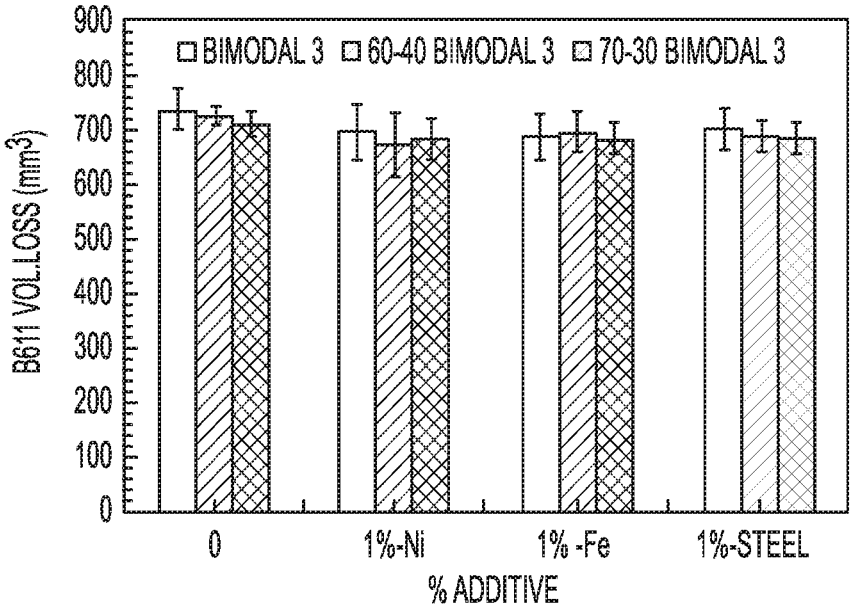
FIG. 23 depicts a volume loss measured according to ASTM B611 for infiltrated samples made from bi-modal blend comprising 50-70 wt % of ultra-coarse tungsten carbide having a particle size of 44 micrometers (325 mesh) and 30-50 wt % of cast carbide having a particle size of 125 micrometers (120 mesh) to about 250 micrometers (60 mesh) containing various alloying elements, in accordance with various aspects of the present disclosure.

The average volume loss of the base and modified bi modal Blend 3 containing various alloying elements during B611 testing is shown in Table 9 and FIG. 23. The data shows a decrease in volume loss i.e. increase in abrasion resistance of the base blends with addition of alloying elements. The data also shows similar volume loss for blends containing Ni, Fe and steel alloying elements.

TABLE 9

Volume loss data of the base and modified bi modal 3 blends containing various alloying elements during B611 testing.

| Sample | Additive | Number of samples | B611 ($mm^3$) Avg. | B611 ($mm^3$) Std. |
|---|---|---|---|---|
| 60-40 Bimodal 3 | 0 | 4 | 723.9 | 15.2 |
| 60-40 Bimodal 3 | 1%—Ni | 4 | 669.5 | 56.2 |
| 60-40 Bimodal 3 | 1%—Fe | 12 | 695.6 | 35.5 |
| 60-40 Bimodal 3 | 1%—Steel | 12 | 686.7 | 29.6 |
| 70-30 Bimodal 3 | 0 | 4 | 709.15 | 22.18 |
| 70-30 Bimodal 3 | 1%—Ni | 4 | 681.86 | 37.24 |
| 70-30 Bimodal 3 | 1%—Fe | 8 | 682.20 | 28.04 |
| 70-30 Bimodal 3 | 1%—Steel | 8 | 682.55 | 28.67 |

Modified Bi Modal Blend 3—Increased/Higher Tapping: Evaluation of TRS values of modified bi modal Blend 3 with alloying elements showed a large difference in maximum and minimum values (Table 7). Without wishing to be bound by theory it was hypothesized that the large variation in the values to be due to the higher amount of UC-WC fraction having a particle size of −325 mesh in the modified blends. The bi modal Blend 3 and modified bi modal Blend 3 in the study were tapped for only 5 cycles prior to infiltration. Further studies were carried out with the bi modal 60/40 Blend 3 mixed with 1 wt. % Ni/1 wt. % Fe/1 wt. % steel at increased tapping of 50 cycles. Blends made with the bi modal 70/30 Blend 3 composition were not considered for further studies as they exhibited inferior erosion resistance i.e. more volume loss during G65 testing.

Figure 24:
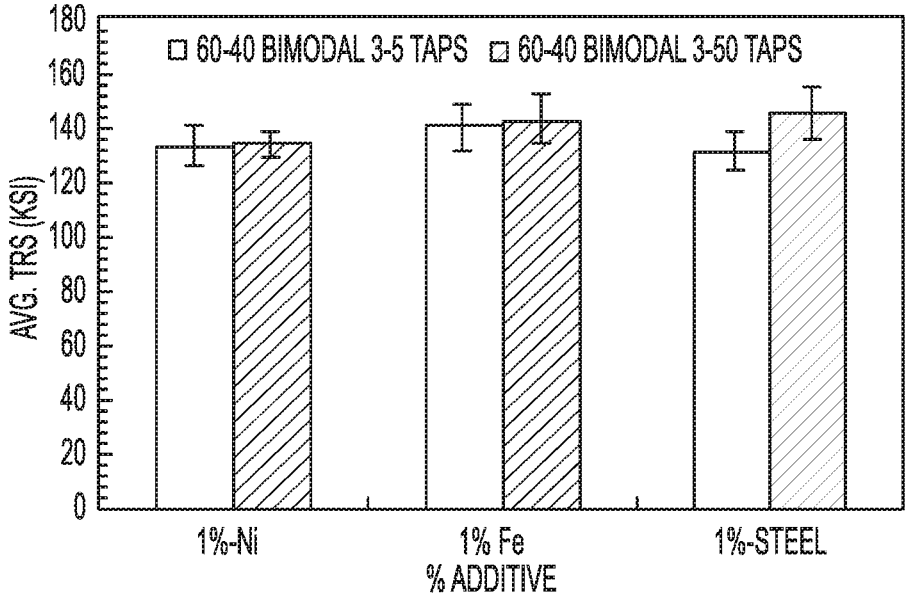
FIG. 24 depicts a comparison of average Transverse Rupture Strength (TRS) values of infiltrated samples made from bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh) containing various alloying elements that were prepared accordingly to the various aspects of the present disclosure and tapped for 5 and 50 cycles.
Figure 25:
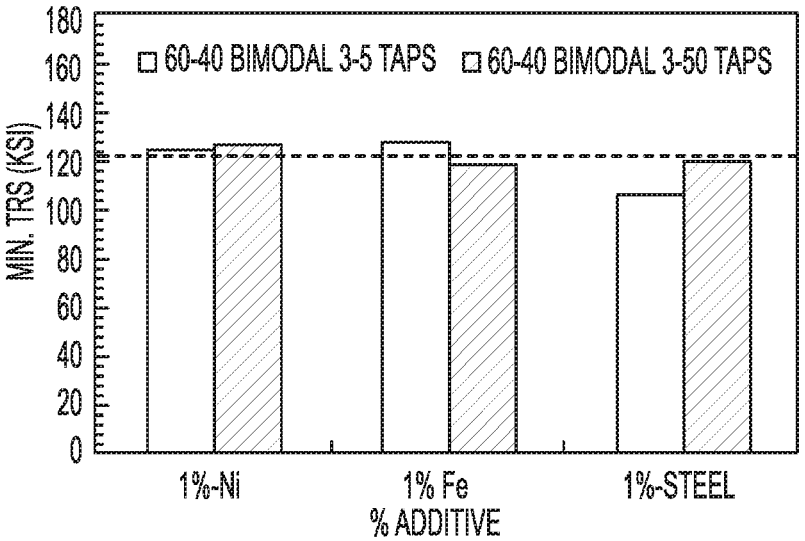
FIG. 25 depicts a comparison of minimal Transverse Rupture Strength (TRS) values of infiltrated samples made from bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh) containing various alloying elements that were prepared accordingly to the various aspects of the present disclosure and tapped for 5 and 50 cycles.

The TRS data of the bi modal Blend 3 with various alloying elements tapped for 5 and 50 cycles is summarized in Table 10. The average and minimum TRS values of the bi modal 60/40 Blend 3 with various alloying elements tapped for 5 and 50 cycles is shown in FIG. 24 and FIG. 25. Increasing the tapping to 50 cycles resulted in an increase in average and minimum TRS values of the bi modal 60/40 Blend 3 comprising 1 wt. % steel. Increasing in tapping to 50 cycles did not have a major effect on TRS values for bi modal 60/40 Blend 3 comprising 1 wt. % Ni/1 wt. % Fe. The bi modal 60/40 Blend 3 comprising Ni and steel additions tapped for 50 cycles showed minimum TRS values greater than 120 KSI. However, the bi modal 60/40 Blend 3 comprising 1 wt. % Fe showed a minimum TRS value slightly lower than 120 KSI.

Figure 26:
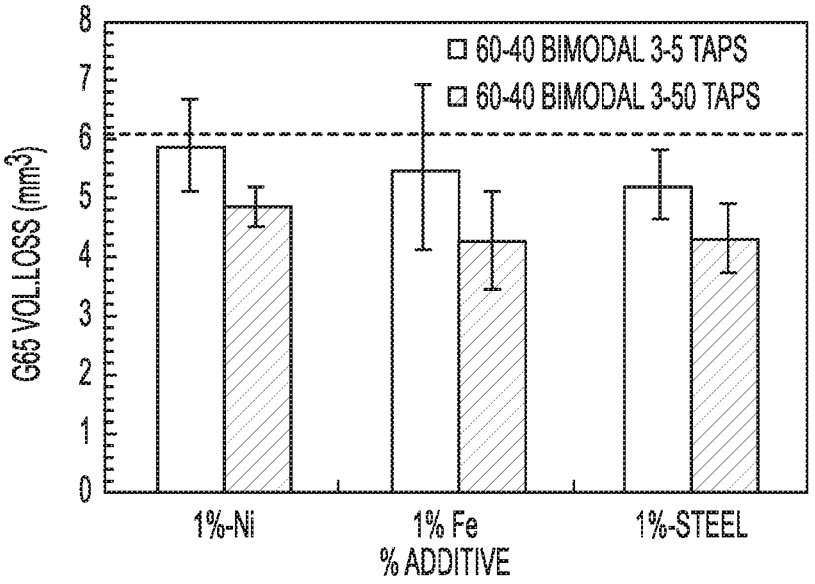
FIG. 26 depicts a volume loss measured according to ASTM G65 for infiltrated samples made from bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh) containing various alloying elements that were prepared accordingly to the various aspects of the present disclosure and tapped for 5 and 50 cycles.

The volume loss during G65 testing of bi modal 60/40 Blend 3 comprising various alloying elements tapped for 5 and 50 cycles is shown in Table 11 and FIG. 26. The average volume loss of the blends decreased significantly with increasing in tapping to 50 cycles. Apart from the average volume loss even the standard deviation in the data also decreased significantly with increasing in tapping to 50 cycles. For example, the standard deviation of blends with 1 wt. % Fe decreased from 1.42 $mm^3$ to 0.81 $mm^3$ with increasing in tapping to 50 cycles. The results clearly suggest lower segregation of powders during tapping for 50 cycles resulting in more uniform and lower volume loss during G65 testing. The bi modal 60/40 Blend 3 comprising 1 wt. % Ni, Fe and steel after tapping for 50 cycles showed a volume loss of 4.86±0.33 $mm^3$, of 4.26±0.81 $mm^3$, and 4.27±0.56 $mm^3$ respectively. The average volume losses of the blends tapped for 50 cycles was approximately 54% and 27%, lower than standard GM 6 (9.76±3.36 $mm^3$) and GTP 90 blends (6.08±0.76 $mm^3$). The bi modal 60/40 Blend 3 comprising 1 wt. % Ni/1 wt. % Fe/1 wt. % steel (after adequate tapping) was identified as suitable compositions for high strength erosion resistant "GTP-ER" body powder blends.

TABLE 11

Volume loss during G65 testing of 60/40 bi modal 3 blends with various alloying elements tapped for 5 and 50 cycles.

| Sample | Additive | G65 ($mm^3$) - 5 taps No. of samples | G65 ($mm^3$) - 5 taps Avg. | G65 ($mm^3$) - 5 taps Std. | G65 ($mm^3$) - 50 taps No. of samples | G65 ($mm^3$) - 50 taps Avg. | G65 ($mm^3$) - 50 taps Std. |
|---|---|---|---|---|---|---|---|
| 60-40 Bimodal 3 | 1%-Ni | 4 | 5.90 | 0.80 | 4 | 4.86 | 0.33 |
| 60-40 Bimodal 3 | 1% Fe | 15 | 5.52 | 1.42 | 8 | 4.26 | 0.81 |
| 60-40 Bimodal 3 | 1%-steel | 12 | 5.23 | 0.56 | 8 | 4.27 | 0.56 |

Figure 27:
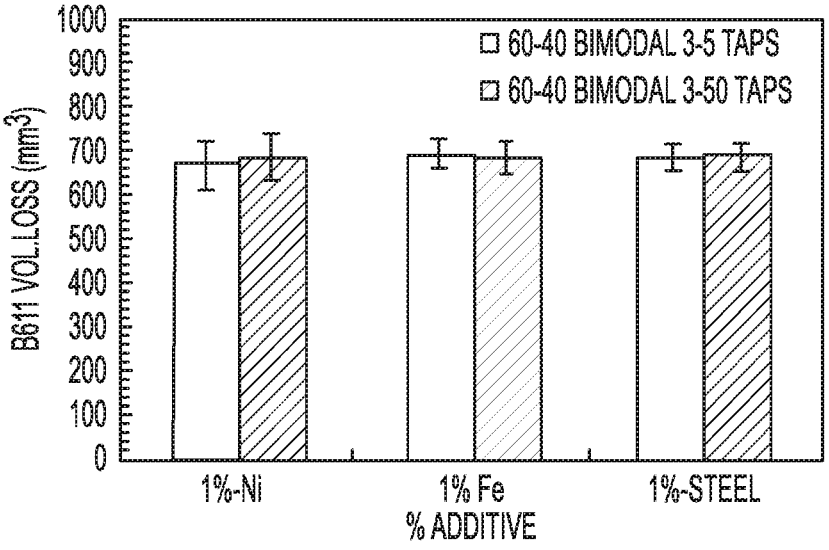
FIG. 27 depicts a volume loss measured according to ASTM B611 for infiltrated samples made from bi-modal blend comprising 60 wt % of ultra-coarse tungsten carbide having a particle size of 44 micrometers (325 mesh) and 40 wt % of cast carbide having a particle size of 125 micrometers (120 mesh) to about 250 micrometers (60 mesh) containing various alloying elements that were prepared accordingly to the various aspects of the present disclosure and tapped for 5 and 50 cycles.

The volume loss during B611 testing of the bi modal 60/40 Blend 3 comprising various alloying elements tapped for 5 and 50 cycles is shown in FIG. 27 and Table 12. The data clearly suggests no effect of tapping for 50 cycles on improving the abrasion resistance of the blends. The bi modal 60/40 Blend 3 comprising various alloying elements showed similar volume loss during B611 testing.

TABLE 10

TRS data of the bi modal 3 blends with various alloying elements tapped for 5 and 50 cycles.

| Sample | Additive | TRS (KSI) - 5 cycles No. of samples | TRS (KSI) - 5 cycles Avg. | TRS (KSI) - 5 cycles Std. | TRS (KSI) - 5 cycles Max | TRS (KSI) - 5 cycles Min | TRS (KSI) - 50 cycles No. of samples | TRS (KSI) - 50 cycles Avg. | TRS (KSI) - 50 cycles Std. | TRS (KSI) - 50 cycles Max | TRS (KSI) - 50 cycles Min |
|---|---|---|---|---|---|---|---|---|---|---|---|
| 60-40 Bimodal 3 | 1%-Ni | 6 | 132.7 | 7.1 | 144.5 | 125.0 | 6 | 133.6 | 5.1 | 139.4 | 127.2 |
| 60-40 Bimodal 3 | 1% Fe | 18 | 140.6 | 8.7 | 156.0 | 128.0 | 12 | 142.9 | 9.2 | 155.0 | 119.2 |
| 60-40 Bimodal 3 | 1%-steel | 18 | 131.3 | 7.2 | 138.2 | 107.5 | 12 | 144.6 | 10.3 | 160.5 | 120.5 |

TABLE 12

Volume loss during B611 testing of 60/40 bi modal 3 blends with various alloying elements tapped for 5 and 50 cycles.

| | | B611 ($mm^3$) - 5 taps | | | B611 ($mm^3$) - 50 taps | | |
|---|---|---|---|---|---|---|---|
| Sample | Additive | No. of samples | Avg. | Std. | No. of samples | Avg. | Std. |
| 60-40 Bimodal 3 | 1%-Ni | 4 | 669.5 | 56.2 | 4 | 685.60 | 52.87 |
| 60-40 Bimodal 3 | 1% Fe | 12 | 695.6 | 35.5 | 8 | 685.25 | 35.78 |
| 60-40 Bimodal 3 | 1%-steel | 12 | 686.7 | 29.6 | 8 | 688.13 | 30.01 |

The volume loss during G76 testing of the bi modal 60/40 Blend 3 comprising various alloying elements tapped 50 cycles is shown in FIG. 28. The bi modal 60/40 Blend 3 comprising various alloying elements showed superior G76 erosion resistance (lower volume loss) than the standard GM6 and GTP 90. The bi modal 60/40 Blend 3 comprising various alloying elements showed approximately 39% lower volume loss during G76 testing than standard GM6 and GTP 90 blends.

The SEM images of the bi modal 60/40 Blend 3 are shown in FIG. 29(A,B,C). It can be observed that the different fractions of the blend have different microstructures. The SEM images show that the surface structure of UC-WC is significantly different from the surface microstructure of CC. While, the surface of UC-WC appears to be smooth and substantially free of a visible roughness in the defined magnification, the surface of CC appears to be rough, with a substantial number of possible ridges and imperfections. Further, without wishing to be bound by any theory, it is hypothesized that the differences in the surface structure of the blends can have a profound effect on the overall performance of the blend.

Methods

Also described herein are the methods of making the disclosed composites and methods of making the same.

Aspects

In view of the described composites and methods and variations thereof, herein below are described certain more particularly described aspects of the inventions. These particularly recited aspects should not however be interpreted to have any limiting effect on any different claims containing different or more general teachings described herein, or that the "particular" aspects are somehow limited in some way other than the inherent meanings of the language and formulas literally used therein Aspect 1: A composite comprising: a) about 40-70 wt % of a first fraction of ultra-coarse tungsten carbide (UC-WC); and b) about 30-60 wt % of a first fraction of cast carbide (CC) having a tap density of about 9-11.5 g/$cm^3$ and exhibiting volume loss of at least 20% lower as compared to the conventional metal powder when measured accordingly to ASTM G65 and ASTM G76.

Aspect 2: The composite of Aspect 1, wherein the first fraction of ultra-coarse tungsten carbide has a particle size from about 44 micrometers (325 mesh) to about 177 micrometers (80 mesh).

Aspect 3: The composite of Aspects 1 or 2, wherein the first fraction of cast carbide has a particle size from 44 micrometers (325 mesh) to about 250 micrometers (60 mesh).

Aspect 4: The composite of any one of Aspects 1-3, wherein the first fraction of ultra-coarse tungsten carbide is present in an amount of about 60%.

Aspect 5: The composite of Aspect 4, wherein the first fraction of cast carbide is present in an amount 40%.

Aspect 6: The composite of Aspects 4 or 5, wherein the first fraction of ultra-coarse tungsten carbide has a particle size of at least about 44 micrometers (325 mesh).

Aspect 7: The composite of any one of Aspects 4-6, wherein the first fraction of cast carbide has a particle size of smaller than about 250 micrometers (50 mesh) but greater than about 125 micrometers (120 mesh).

Aspect 8: The composite of any one of Aspects 1-7, further comprising greater than 0 wt % to about 5 wt % of nickel.

Aspect 9: The composite of any one of Aspects 1-8, further comprising greater than 0 wt % to about 5 wt % of iron.

Aspect 10: The composite of any one of Aspects 1-9, further comprising one or more of: (a) from about 5 to about 25 wt % of a second fraction of ultra-coarse tungsten carbide having a particle size of greater than 63 micrometer (230 mesh) but smaller than 88 micrometer (170 mesh); (b) from about 5 to about 25 wt % of a third fraction of ultra-coarse tungsten carbide having a particle size of greater than 44 micrometer (325 mesh) but smaller than 63 micrometer (230 mesh); (c) from about 5 to about 25 wt % of a second fraction of cast carbide having a particle size of greater than 63 micrometer (230 mesh) but smaller than 88 micrometer (170 mesh); or d) from about 5 to about 25 wt % of a third fraction of cast carbide having a particle size of greater than 63 micrometer (230 mesh) but smaller than 125 micrometer (120 mesh).

Aspect 11: The composite of any one of Aspects 1-10, wherein the composite is infiltrated with a copper containing alloy.

Aspect 12: The composite of any one of Aspects 1-11 exhibiting a Transverse Rupture Strength (TRS) of greater than 120 KSI.

Aspect 13: The composite of any one of Aspects 1-12, exhibiting of a volume loss under abrasion testing according to ASTM G65 of less than about 6 $mm^3$.

Aspect 14: The composite of any one of Aspects 1-13, wherein cast carbide has a plurality of particles having a microstructured surface.

Aspect 15: A method for preparing a composite comprising: a) contacting about 40-70 wt % of a first fraction of ultra coarse tungsten carbide with about 30-60 wt % of a first fraction of cast carbide (CC) to form a blend; b) tapping the blend for at least 5 cycles; and c) infiltrating the blend with a copper containing alloy, wherein the formed composite has a tap density of about 9-11.5 g/$cm^3$ and exhibits volume loss of at least 20% lower as compared to the conventional metal powder when measured accordingly to ASTM G65 and ASTM G76.

Aspect 16: The method of Aspect 15, wherein the first fraction of ultra-coarse tungsten carbide has a particle size from about 44 micrometers (325 mesh) to about 177 micrometers (80 mesh).

Aspect 17: The method of Aspect 15 or 16, wherein the first fraction of cast carbide has a particle size from 44 micrometers (325 mesh) to about 250 micrometers (60 mesh).

Aspect 18: The method of any one of Aspect 15-17, wherein the first fraction of ultra-coarse tungsten carbide is present in an amount of about 60%.

Aspect 19: The method of Aspect 18, wherein the first fraction of cast carbide is present in an amount 40%.

Aspect 20: The method of Aspects 18 or 19, wherein the first fraction of ultra-coarse tungsten carbide has a particle size of at least about 44 micrometers (325 mesh).

Aspect 21: The method of any one of Aspects 18-20, wherein the first fraction of cast carbide has a particle size of smaller than about 250 micrometers (60 mesh) but greater than about 125 micrometers (120 mesh).

Aspect 22: The method of any one of Aspects 15-21, further comprising a step of mixing the blend with greater than 0 wt % to about 5 wt % of nickel prior to the step of infiltrating.

Aspect 23: The method of any one of Aspects 15-22, further comprising a step of mixing the blend with greater than 0 wt % to about 5 wt % of iron prior to the step of infiltrating.

Aspect 24: The method of any one of Aspects 15-23, further comprising a step of mixing the blend with one or more of: (a) from about 5 to about 25 wt % of a second fraction of ultra-coarse tungsten carbide having a particle size of greater than 63 micrometer (230 mesh) but smaller than 88 micrometer (170 mesh); (b) from about 5 to about 25 wt % of a third fraction of ultra-coarse tungsten carbide having a particle size of greater than 44 micrometer (325 mesh) but smaller than 63 micrometer (230 mesh); (c) from about 5 to about 25 wt % of a second fraction of cast carbide having a particle size of greater than 63 micrometer (230 mesh) but smaller than 88 micrometer (170 mesh); or d) from about 5 to about 25 wt % of a third fraction of cast carbide having a particle size of greater than 63 micrometer (230 mesh) but smaller than 125 micrometer (120 mesh) prior to the step of infiltrating.

Aspect 25: The method of any one of Aspects 15-24, wherein the formed composite exhibits a Transverse Rupture Strength (TRS) of greater than 120 KSI.

Aspect 26: The method of any one of Aspects 15-25, wherein the formed composite exhibits a volume loss under abrasion testing according to ASTM G65 of less than about 6 $mm^3$.

Aspect 27: The method of any one of Aspects 15-126, wherein the cast carbide has a plurality of particles having a microstructured surface.

What is claimed is:

1. A method for preparing a composite comprising:

a) contacting about 40-70 wt % of a first fraction of ultra coarse tungsten carbide
with about 30-60 wt % a first fraction of cast carbide (CC) to form a blend, wherein the blend has a tap density of about 9-11.5 $g/cm^3$;

b) tapping the blend for at least 5 cycles; and c) infiltrating the tapped blend with a copper containing alloy, thereby forming the composite,
wherein the formed composite exhibits volume loss of at least 20% lower as compared to a conventional GM-6 metal powder when measured accordingly to ASTM G65 and ASTM G76.

2. The method of claim 1, wherein the first fraction of ultra-coarse tungsten carbide has a particle size from about 44 micrometers (325 mesh) to about 177 micrometers (80 mesh).

3. The method of claim 1, wherein the first fraction of cast carbide has a particle size from 44 micrometers (325 mesh) to about 250 micrometers (60 mesh).

4. The method of claim 1, wherein the first fraction of ultra-coarse tungsten carbide is present in an amount of about 60%.

5. The method of claim 4, wherein the first fraction of cast carbide is present in an amount 40%.

6. The method of claim 4, wherein the first fraction of ultra-coarse tungsten carbide has a particle size of at least about 44 micrometers (325 mesh).

7. The method of claim 4, wherein the first fraction of cast carbide has a particle size of smaller than about 250 micrometers (60 mesh) but greater than about 125 micrometers (120 mesh).

8. The method of claim 1, further comprising a step of mixing the blend with greater than 0 wt % to about 5 wt % of nickel prior to the step of infiltrating.

9. The method of claim 1, further comprising a step of mixing the blend with greater than 0 wt % to about 5 wt % of iron prior to the step of infiltrating.

10. The method of claim 1, further comprising a step of mixing the blend with one or more of: (a) from about 5 to about 25 wt % of a second fraction of ultra-coarse tungsten carbide having a particle size of greater than 63 micrometer (230 mesh) but smaller than 88 micrometer (170 mesh); (b) from about 5 to about 25 wt % of a third fraction of ultra-coarse tungsten carbide having a particle size of greater than 44 micrometer (325 mesh) but smaller than 63 micrometer (230 mesh); (c) from about 5 to about 25 wt % of a second fraction of cast carbide having a particle size of greater than 63 micrometer (230 mesh) but smaller than 88 micrometer (170 mesh); or d) from about 5 to about 25 wt % of a third fraction of cast carbide having a particle size of greater than 63 micrometer (230 mesh) but smaller than 125 micrometer (120 mesh) prior to the step of infiltrating.

11. The method of claim 1, wherein the formed composite exhibits a Transverse Rupture Strength (TRS) of greater than 120 KSI.

12. The method of claim 1, wherein the formed composite exhibits a volume loss under abrasion testing according to ASTM G65 of less than about 6 $mm^3$.

13. The method of claim 1, wherein the cast carbide has a plurality of particles having a microstructured surface.

14. The method of claim 1, wherein the method comprises tapping the blend for at least 50 cycles.

15. The method of claim 14, wherein the formed composite exhibits an average volume loss under abrasion testing according to ASTM G65 from 4.26 $mm^3$ to 4.86 $mm^3$.

16. The method of claim 14, wherein the formed composite exhibits an average Transverse Rupture Strength (TRS) of from 133.6 KSI to 144.6 KSI.

17. The method of claim 14, further comprising a step of mixing the blend with greater than 0 wt % to about 5 wt % of nickel prior to the step of infiltrating.

18. The method of claim 14, further comprising a step of mixing the blend with greater than 0 wt % to about 5 wt % of iron prior to the step of infiltrating.

* * * * *